US011086244B1

(12) United States Patent
Veregin et al.

(10) Patent No.: US 11,086,244 B1
(45) Date of Patent: Aug. 10, 2021

(54) TITANIA-FREE TONER ADDITIVE FORMULATION WITH CROSS-LINKED ORGANIC POLYMERIC ADDITIVE

(71) Applicant: Xerox Corporation, Norwalk, CT (US)

(72) Inventors: Richard P. N. Veregin, Mississauga (CA); Michael F. Zona, Webster, NY (US); Jordan A. Frank, Rochester, NY (US); Daniel W. Asarese, Honeoye Falls, NY (US); Chieh-Min Cheng, Rochester, NY (US); Paul K. Acquaviva, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 16/800,236

(22) Filed: Feb. 25, 2020

(51) Int. Cl.

| | |
|---|---|
| ***G03G 9/08*** | (2006.01) |
| ***G03G 9/097*** | (2006.01) |
| ***G03G 9/087*** | (2006.01) |
| ***G03G 15/08*** | (2006.01) |
| ***G03G 9/093*** | (2006.01) |

(52) U.S. Cl.
CPC ..... *G03G 9/09708* (2013.01); *G03G 9/0819* (2013.01); *G03G 9/08711* (2013.01); *G03G 9/08755* (2013.01); *G03G 9/09328* (2013.01); *G03G 9/09371* (2013.01); *G03G 9/09716* (2013.01); *G03G 9/09725* (2013.01); *G03G 9/09733* (2013.01); *G03G 15/08* (2013.01)

(58) Field of Classification Search
CPC ..... G03G 9/09716; G03G 9/09725; G03G 9/09733
USPC ..... 430/108.3
See application file for complete search history.

(56) References Cited

U.S. PATENT DOCUMENTS

| | | | |
|---|---|---|---|
| 3,590,000 | A | 6/1971 | Palermiti et al. |
| 3,681,106 | A | 8/1972 | Burn et al. |
| 3,847,604 | A | 11/1974 | Hagenbach et al. |
| 4,298,672 | A | 11/1981 | Lu |
| 4,338,390 | A | 7/1982 | Lu |
| 4,845,006 | A | 7/1989 | Matsubara et al. |
| 4,863,824 | A | 9/1989 | Uchida et al. |
| 4,863,825 | A | 9/1989 | Yoshimoto et al. |
| 4,917,983 | A | 4/1990 | Uchida et al. |
| 4,931,370 | A | 6/1990 | Amaya et al. |
| 4,933,252 | A | 6/1990 | Nishikawa et al. |
| 4,935,326 | A | 6/1990 | Creatura et al. |
| 4,937,166 | A | 6/1990 | Creatura et al. |
| 4,973,539 | A | 11/1990 | Sacripante et al. |
| 4,980,448 | A | 12/1990 | Tajiri et al. |
| 4,981,939 | A | 1/1991 | Matsumura et al. |
| 4,988,794 | A | 1/1991 | Kubo et al. |
| 5,057,596 | A | 10/1991 | Kubo et al. |
| 5,143,809 | A | 9/1992 | Kaneko et al. |
| 5,227,460 | A | 7/1993 | Mahabadi et al. |
| 5,236,629 | A | 8/1993 | Mahabadi et al. |
| 5,290,654 | A | 3/1994 | Sacripante et al. |
| 5,302,486 | A | 4/1994 | Patel et al. |
| 5,330,874 | A | 7/1994 | Mahabadi et al. |
| 5,376,494 | A | 12/1994 | Mahabadi et al. |
| 5,480,756 | A | 1/1996 | Mahabadi et al. |
| 5,500,324 | A | 3/1996 | Mahabadi et al. |
| 5,601,960 | A | 2/1997 | Mahabadi et al. |
| 5,629,121 | A | 5/1997 | Nakayama |
| 5,650,484 | A | 7/1997 | Hawkins et al. |
| 5,750,909 | A | 5/1998 | Hawkins et al. |
| 6,063,827 | A | 5/2000 | Sacripante et al. |
| 6,120,967 | A | 9/2000 | Hopper et al. |
| 6,214,507 | B1 | 4/2001 | Sokol et al. |
| 6,326,119 | B1 | 12/2001 | Hollenbaugh, Jr. et al. |
| 6,358,657 | B1 | 3/2002 | Silence et al. |
| 6,359,105 | B1 | 3/2002 | Ianni et al. |
| 6,592,913 | B2 | 7/2003 | Cook et al. |
| 6,593,053 | B1 | 7/2003 | Chang et al. |
| 7,300,734 | B2 | 11/2007 | Mcdougall et al. |
| 8,163,450 | B2 | 4/2012 | Kishida |
| 8,507,166 | B2 | 8/2013 | Lofftus et al. |
| 8,663,886 | B2 | 3/2014 | Vanbesien et al. |
| 8,916,317 | B2 | 12/2014 | Iftime et al. |
| 10,358,557 | B1 | 7/2019 | Veregin et al. |
| 2012/0156605 | A1 | 6/2012 | Vanbesien et al. |
| 2012/0156606 | A1 | 6/2012 | Vanvesien et al. |
| 2017/0010554 | A1 | 1/2017 | Veregin et al. |
| 2017/0212439 | A1* | 7/2017 | Srinivasan ..... G03G 9/08755 |

OTHER PUBLICATIONS

Jordan A. Frank, et al., U.S. Appl. No. 16/800,176, filed Feb. 25, 2020.
Richard P. N. Veregin, et al., U.S. Appl. No. 16/800,118, filed Feb. 25, 2020.
Richard P. N. Veregin, et al., U.S. Appl. No. 16/369,013, filed Mar. 29, 2019.
Richard P. N. Veregin, et al., U.S. Appl. No. 16/369,126, filed Mar. 29, 2019.
Extended European Search Report issued in European Application No. 21155883.8-1107, dated Jun. 8, 2021.

* cited by examiner

*Primary Examiner* — Mark A Chapman
(74) *Attorney, Agent, or Firm* — Marylou J. Lavoie, Esq. LLC

(57) ABSTRACT

A toner including a parent toner particle comprising at least one resin, in combination with an optional colorant, and an optional wax; and a surface additive formulation comprising at least one medium silica surface additive; at least one large cross-linked organic polymeric additive; at least one positive charging surface additive, wherein the at least one positive charging surface additive is (a) a titanium dioxide surface additive; and wherein the parent toner particles further contain a small silica; or (b) a non-titanium dioxide positive charging metal oxide surface additive; and wherein the parent toner particles further optionally contain a small silica; and wherein a total surface area coverage of all of the surface additives combined is 100 to 140 percent of the parent toner particle surface area.

20 Claims, No Drawings

TITANIA-FREE TONER ADDITIVE FORMULATION WITH CROSS-LINKED ORGANIC POLYMERIC ADDITIVE

RELATED APPLICATIONS

Commonly assigned U.S. patent application Ser. No. 16/800,118, entitled "Toner Including Toner Additive Formulation"), filed concurrently herewith, which is hereby incorporated by reference herein in its entirety, describes a toner comprising a parent toner particle comprising at least one resin, in combination with an optional colorant, and an optional wax; and a surface additive formulation comprising: at least one medium silica surface additive having a volume average primary particle diameter of 30 to 50 nanometers, the at least one medium silica provided at a surface area coverage of 40 to 100 percent of the parent toner particle surface area; at least one large silica surface additive having a volume average primary particle diameter of 80 to 120 nanometers, the at least one large silica provided at a surface area coverage of 5 to 29 percent of the parent toner particle surface area; at least one positive charging surface additive, wherein the at least one positive charging surface additive is: (a) a titanium dioxide surface additive having an average primary particle size of 15 to 40 nanometers, the titanium dioxide present in an amount of less than or equal to 1 part per hundred based on 100 parts of the parent toner particles; and wherein the parent toner particles further contain a small silica having a volume average primary particle diameter of 8 to 16 nanometers, the small silica present at a surface area coverage of 5 to 75 percent of the parent toner particle surface area; or (b) a non-titanium dioxide positive charging metal oxide surface additive, wherein the non-titanium dioxide positive charging metal oxide surface additive has a volume average primary particle size of 8 to 30 nanometers, and wherein the non-titanium dioxide positive charging metal oxide surface additive is present at a surface area coverage of 5 to 15 percent of the parent toner particle surface area; and wherein the parent toner particles further optionally contain a small silica surface additive having a volume average primary particle diameter of 8 to 16 nanometers, the small silica present at a surface area coverage of 0 to 75 percent of the parent toner particle surface area; and wherein a total surface area coverage of all of the surface additives combined is 100 to 140 percent of the parent toner particle surface area.

BACKGROUND

Disclosed herein is a toner comprising: a parent toner particle comprising at least one resin, in combination with an optional colorant, and an optional wax; and a surface additive formulation comprising: at least one medium silica surface additive having an average primary particle diameter of 30 to 50 nanometers, the at least one medium silica provided at a surface area coverage of 40 to 100 percent of the parent toner particle surface area; at least one large cross-linked organic polymeric additive having an average primary particle diameter of 75 to 120 nanometers, the at least one large cross-linked organic polymeric additive provided at a surface area coverage of 5 to 29 percent of the parent toner particle surface area; at least one positive charging surface additive, wherein the at least one positive charging surface additive is; (a) a titanium dioxide surface additive having an average primary particle size of 15 to 40 nanometers, the titanium dioxide present in an amount of less than or equal to 1 part per hundred based on 100 parts of the parent toner particles; and wherein the parent toner particles further contain a small silica having an average primary particle diameter of 8 to 16 nanometers, the small silica present at a surface area coverage of 5 to 75 percent of the parent toner particle surface area; or (b) a non-titanium dioxide positive charging metal oxide surface additive, wherein the non-titanium dioxide positive charging metal oxide surface additive has an average primary particle size of 8 to 30 nanometers, and wherein the non-titanium dioxide positive charging metal oxide surface additive is present at a surface area coverage of 5 to 15 percent of the parent toner particle surface area; and wherein the parent toner particles further optionally contain a small silica having an average primary particle diameter of 8 to 16 nanometers, the small silica present at a surface area coverage of 0 to 75 percent of the parent toner particle surface area; and wherein a total surface area coverage of all of the surface additives combined is 100 to 140 percent of the parent toner particle surface area.

Also disclosed is a toner process comprising: contacting at least one resin; an optional wax; an optional colorant; and an optional aggregating agent; heating to form aggregated toner particles; optionally, adding a shell resin to the aggregated toner particles, and heating to a further elevated temperature to coalesce the particles; adding a surface additive comprising: at least one medium silica surface additive having an average primary particle diameter of 30 to 50 nanometers, the at least one medium silica provided at a surface area coverage of 40 to 100 percent of the parent toner particle surface area; at least one large cross-linked organic polymeric additive having an average primary particle diameter of 75 to 120 nanometers, the at least one large cross-linked organic polymeric additive provided at a surface area coverage of 5 to 29 percent of the parent toner particle surface area; at least one positive charging surface additive, wherein the at least one positive charging surface additive is: (a) a titanium dioxide surface additive having an average primary particle size of 15 to 40 nanometers, the titanium dioxide present in an amount of less than or equal to 1 part per hundred based on 100 parts of the parent toner particles; and wherein the parent toner particles further contain a small silica having an average primary particle diameter of 8 to 16 nanometers, the small silica present at a surface area coverage of 5 to 75 percent of the parent toner particle surface area; or (b) a non-titanium dioxide positive charging metal oxide surface additive, wherein the non-titanium dioxide positive charging metal oxide surface additive has an average primary particle size of 8 to 30 nanometers, and wherein the non-titanium dioxide positive charging metal oxide surface additive is present at a surface area coverage of 5 to 15 percent of the parent toner particle surface area; and wherein the parent toner particles further optionally contain a small silica having an average primary particle diameter of 8 to 16 nanometers, the small silica present at a surface area coverage of 0 to 75 percent of the parent toner particle surface area; and wherein a total surface area coverage of all of the surface additives combined is 100 to 140 percent of the parent toner particle surface area; and optionally, recovering the toner particles.

Electrophotographic printing utilizes toner particles, which may be produced by a variety of processes. One such process includes an emulsion aggregation ("EA") process that forms toner particles in which surfactants are used in forming a latex emulsion. See, for example, U.S. Pat. No. 6,120,967, the disclosure of which is hereby incorporated by reference in its entirety, as one example of such a process.

Combinations of amorphous and crystalline polyesters may be used in the EA process. This resin combination may provide toners with high gloss and relatively low-melting point characteristics (sometimes referred to as low-melt, ultra low melt, or ULM), which allows for more energy efficient and faster printing. Other toner resins may also be selected for the toner such as styrene or styrene acrylate copolymers. Such resins may include one or more resins selected from the group consisting of styrenes, acrylates, methacrylates, butadienes, isoprenes, acrylic acids, methacrylic acids, acrylonitriles, copolymers thereof, and combinations thereof. The toner may also be hybrid toners where a combination of polyester resin and other resin, such as styrene, etc., are used in the toner particle.

The use of additives with EA toner particles may be important in realizing optimal toner performance, such as, for providing improved charging characteristics, improved flow properties, and the like. Poor fusing creates problems in paper adhesion and print performance. Poor toner flow cohesion can affect toner dispense, which creates problems in gravity-fed cartridges, and leads to deletions on paper. In addition, the use of additives with EA toner particles may also mitigate bias charge roller (BCR) contamination.

U.S. Pat. No. 8,663,886, which is hereby incorporated by reference herein in its entirety, describes in the Abstract thereof polymeric additives for use with toner particles. The polymeric additive includes a copolymer possessing at least one monomer having a high carbon to oxygen ration, a monomer having more than one vinyl group, and at least one amine-functional monomer.

U.S. patent application Ser. No. 15/914,411 of Richard P. N. Veregin et al., entitled "Toner Compositions And Surface Polymer Additives," which is hereby incorporated by reference herein in its entirety, describes in the Abstract thereof a polymeric composition for use with toner particles. The polymeric composition includes a silicone-polyether copolymer and a polymeric additive, wherein the silicone-polyether copolymer comprises a polysiloxane unit and a polyether unit, and the polymeric additive comprises a copolymer possessing at least one monomer having a high carbon to oxygen ratio, a monomer having more than one vinyl group, and at least one amine-functional monomer.

There is a continual need for improving the additives used in toners, including formation of EA toners, especially low-melt EA toners to improve toner flow, toner blocking which leads to poor toner flow or toner caking at high temperature, toner charge, and reduce BCR contamination. There is also a continual need to develop lower cost EA toners.

Due to certain regulatory requirements, compositions, including toners, having one percent or more titania are expected to eventually require special labeling. Further, having titania in a toner formulation is anticipated to be an issue for Blue Angel certifications. In addition, silica and titania additives add considerable cost to the toner formulation. Thus, there is a desire to reduce or eliminate titania in toner formulations.

Currently available toners and toner processes are suitable for their intended purposes. However a need remains for improved toners and toner processes. Further, a need remains for improved emulsion aggregation toners and toner processes. Further, a need remains for toner compositions having performance characteristics as good or better than prior compositions while meeting the desire for reduced amounts of titania. Further, a need remains for toner compositions that can perform as desired without requiring titania additives.

The appropriate components and process aspects of the each of the foregoing U. S. Patents and Patent Publications may be selected for the present disclosure in embodiments thereof. Further, throughout this application, various publications, patents, and published patent applications are referred to by an identifying citation. The disclosures of the publications, patents, and published patent applications referenced in this application are hereby incorporated by reference into the present disclosure to more fully describe the state of the art to which this invention pertains.

SUMMARY

Described is a toner comprising: a parent toner particle comprising at least one resin, in combination with an optional colorant, and an optional wax; and a surface additive formulation comprising: at least one medium silica surface additive having an average primary particle diameter of 30 to 50 nanometers, the at least one medium silica provided at a surface area coverage of 40 to 100 percent of the parent toner particle surface area; at least one large cross-linked organic polymeric additive having an average primary particle diameter of 75 to 120 nanometers, the at least one large cross-linked organic polymeric additive provided at a surface area coverage of 5 to 29 percent of the parent toner particle surface area; at least one positive charging surface additive, wherein the at least one positive charging surface additive is; (a) a titanium dioxide surface additive having an average primary particle size of 15 to 40 nanometers, the titanium dioxide present in an amount of less than or equal to 1 part per hundred based on 100 parts of the parent toner particles; and wherein the parent toner particles further contain a small silica having an average primary particle diameter of 8 to 16 nanometers, the small silica present at a surface area coverage of 5 to 75 percent of the parent toner particle surface area; or (b) a non-titanium dioxide positive charging metal oxide surface additive, wherein the non-titanium dioxide positive charging metal oxide surface additive has an average primary particle size of 8 to 30 nanometers, and wherein the non-titanium dioxide positive charging metal oxide surface additive is present at a surface area coverage of 5 to 15 percent of the parent toner particle surface area; and wherein the parent toner particles further optionally contain a small silica having an average primary particle diameter of 8 to 16 nanometers, the small silica present at a surface area coverage of 0 to 75 percent of the parent toner particle surface area; and wherein a total surface area coverage of all of the surface additives combined is 100 to 140 percent of the parent toner particle surface area.

Also described is a toner process comprising: contacting at least one resin; an optional wax; an optional colorant; and an optional aggregating agent; heating to form aggregated toner particles; optionally, adding a shell resin to the aggregated toner particles, and heating to a further elevated temperature to coalesce the particles; adding a surface additive comprising: at least one medium silica surface additive having an average primary particle diameter of 30 to 50 nanometers, the at least one medium silica provided at a surface area coverage of 40 to 100 percent of the parent toner particle surface area; at least one large cross-linked organic polymeric additive having an average primary particle diameter of 75 to 120 nanometers, the at least one large cross-linked organic polymeric additive provided at a surface area coverage of 5 to 29 percent of the parent toner particle surface area; at least one positive charging surface additive, wherein the at least one positive charging surface additive is; (a) a titanium dioxide surface additive having an average primary particle size of 15 to 40 nanometers, the titanium dioxide present in an amount of less than or equal to 1 part per hundred based on 100 parts of the parent toner particles; and wherein the parent toner particles further contain a small silica having an average primary particle diameter of 8 to 16 nanometers, the small silica present at a surface area coverage of 5 to 75 percent of the parent toner particle surface area; or (b) a non-titanium dioxide positive charging metal oxide surface additive, wherein the non-titanium dioxide positive charging metal oxide surface additive has an average primary particle size of 8 to 30 nanometers, and wherein the non-titanium dioxide positive charging metal oxide surface additive is present at a surface area coverage of 5 to 15 percent of the parent toner particle surface area; and wherein the parent toner particles further optionally contain a small silica having an average primary particle diameter of 8 to 16 nanometers, the small silica present at a surface area coverage of 0 to 75 percent of the parent toner particle surface area; and wherein a total surface area coverage of all of the surface additives combined is 100 to 140 percent of the parent toner particle surface area; and optionally, recovering the toner particles.

DETAILED DESCRIPTION

The present disclosure provides a toner providing desired performance characteristics including one or a combination of one or more of sufficient, acceptable, or outstanding flow, charge, charge distribution, photoreceptor cleanability, developer flow properties, and storage performance after treatment under high humidity conditions. A toner composition is provided having a toner surface additive formulation to reduce or replace titania surface additives.

In embodiments, a toner is provided comprising a parent toner particle comprising at least one resin, in combination with an optional colorant, and an optional wax; and a surface additive formulation comprising: at least one medium silica surface additive having an average primary particle diameter of 30 to 50 nanometers, the at least one medium silica provided at a surface area coverage of 40 to 100 percent of the parent toner particle surface area; at least one large cross-linked organic polymeric additive having an average primary particle diameter of 75 to 120 nanometers, the at least one large cross-linked organic polymeric additive provided at a surface area coverage of 5 to 29 percent of the parent toner particle surface area; at least one positive charging surface additive, wherein the at least one positive charging surface additive is: (a) a titanium dioxide surface additive having an average primary particle size of 15 to 40 nanometers, the titanium dioxide present in an amount of less than or equal to 1 part per hundred based on 100 parts of the parent toner particles; and wherein the parent toner particles further contain a small silica having an average primary particle diameter of 8 to 16 nanometers, the small silica present at a surface area coverage of 5 to 75 percent of the parent toner particle surface area; or (b) a non-titanium dioxide positive charging metal oxide surface additive, wherein the non-titanium dioxide positive charging metal oxide surface additive has an average primary particle size of 8 to 30 nanometers, and wherein the non-titanium dioxide positive charging metal oxide surface additive is present at a surface area coverage of 5 to 15 percent of the parent toner particle surface area; and wherein the parent toner particles further optionally contain a small silica having an average primary particle diameter of 8 to 16 nanometers, the small silica present at a surface area coverage of 0 to 75 percent of the parent toner particle surface area; and wherein a total surface area coverage of all of the surface additives combined is 100 to 140 percent of the parent toner particle surface area.

The toner surface additive formulation may be combined with toner resins, optionally possessing colorants, to form a toner of the present disclosure.

Any toner resin may be utilized in forming a toner of the present disclosure. Such resins, in turn, may be made of any suitable monomer or monomers via any suitable polymerization method. In embodiments, the resin may be prepared by a method other than emulsion polymerization. In further embodiments, the resin may be prepared by condensation polymerization.

The toner may comprises one or more polyester resins. In embodiments, the polyester resins may be amorphous, crystalline, or a combination of amorphous polyester and crystalline polyester. In other embodiments, the toner comprises a styrene or styrene-acrylate resin. In other embodiments, the toner may comprise a hybrid toner containing two or more types of toner resins, such as polyester and styrene-acrylate.

Amorphous Resin.

In embodiments, the toner compositions comprise at least one amorphous polyester. In embodiments, the toner compositions comprise at least one amorphous polyester and at least one crystalline polyester. In certain embodiments, the at least one polyester comprises a first amorphous polyester and a second amorphous polyester that is different from the first amorphous polyester. In further embodiments, the at least one polyester in the toner comprises a first amorphous polyester and a second amorphous polyester that is different from the first amorphous polyester, and a crystalline polyester.

The amorphous resin may be an amorphous polyester resin formed by reacting a diol with a diacid in the presence of an optional catalyst. Examples of diacids or diesters including vinyl diacids or vinyl diesters utilized for the preparation of amorphous polyesters and include dicarboxylic acids or diesters such as terephthalic acid, phthalic acid, isophthalic acid, fumaric acid, trimellitic acid, dimethyl fumarate, dimethyl itaconate, cis-1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacids or diesters may be present, for example, in an amount from about 40 to about 60 mole percent of the resin, from about 42 to about 52 mole percent of the resin, or from about 45 to about 50 mole percent of the resin.

Examples of diols which may be utilized in generating an amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The amount of organic diols selected may vary, for example, the organic diols may be present in an amount from about 40 to about 60 mole percent of the resin, from about 42 to about 55 mole percent of the resin, or from about 45 to about 53 mole percent of the resin.

Examples of suitable amorphous resins include polyesters, polyamides, polyimides, polyolefins, polyethylene, polybutylene, polyisobutyrate, ethylene-propylene copolymers, ethylene-vinyl acetate copolymers, olypropylene, and the like, and mixtures thereof.

An unsaturated amorphous polyester resin may be utilized as a resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

A suitable polyester resin may be an amorphous polyester such as a poly(propoxylated bisphenol A co-fumarate) resin. Examples of such resins and processes for their production include those disclosed in U.S. Pat. No. 6,063,827, the disclosure of which is hereby incorporated by reference in its entirety.

Suitable polyester resins include amorphous acidic polyester resins. An amorphous acid polyester resin may be based on any combination of propoxylated bisphenol A, ethoxylated bisphenol A, terephthalic acid, fumaric acid, and dodecenyl succinic anhydride, such as poly(propoxylated bisphenol-co-terephthlate-fumarate-dodecenylsuccinate). Another amorphous acid polyester resin which may be used is poly(propoxylated-ethoxylated bisphenol-co-terephthalate-dodecenylsuccinate-trimellitic anhydride).

An example of a linear propoxylated bisphenol A fumarate resin which may be utilized as a resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

An amorphous resin or combination of amorphous resins may be present, for example, in an amount of from about 5% to about 95% by weight of the toner, from about 30% to about 90% by weight of the toner, or from about 35% to about 85% by weight of the toner.

In embodiments, the toner composition comprises amorphous polyester in an amount of from about 73 to about 78 percent by weight based upon the total weight of the toner composition. In certain embodiments, the toner composition comprises a first amorphous polyester and a second amorphous polyester that is different from the first amorphous polyester, and the total amount of amorphous polyester including both the first and second amorphous polyester is from about 73 to about 78 percent by weight based upon the total weight of the toner composition.

The amorphous resin or combination of amorphous resins may have a glass transition temperature of from about 30° C. to about 80° C., from about 35° C. to about 70° C., or from about 40° C. to about 65° C. The glass transition temperature may be measured using differential scanning calorimetry (DSC). The amorphous resin may have a Mn as measured by GPC of, for example, from about 1,000 to about 50,000, from about 2,000 to about 25,000, or from about 1,000 to about 10,000, and a Mw of, for example, from about 2,000 to about 100,000, from about 5,000 to about 90,000, from about 10,000 to about 90,000, from about 10,000 to about 30,000, or from about 70,000 to about 100,000, as determined by GPC.

In embodiments, one, two, or more resins may be used. Where two or more resins are used, the resins may be in any suitable ratio (e.g., weight ratio) such as for instance, of from about 1% (first resin)/99% (second resin) to about 99% (first resin)/1% (second resin), from about 10% (first resin)/90% (second resin) to about 90% (first resin)/10% (second resin). Where the resins include a combination of amorphous and crystalline resins, the resins may be in a weight ratio of, for example, from about 1% (crystalline resin)/99% (amorphous resin) to about 99% (crystalline resin)/1% (amorphous resin), or from about 10% (crystalline resin)/90% (amorphous resin) to about 90% (crystalline resin)/10% (amorphous resin). In some embodiments, the weight ratio of the resins is from about 80% to about 60% of the amorphous resin and from about 20% to about 40% of the crystalline resin. In such embodiments, the amorphous resin may be a combination of amorphous resins, e.g., a combination of two amorphous resins.

Crystalline Resin.

In embodiments, the toners herein include a crystalline polyester. The crystalline resin herein may be a crystalline polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 2,2-dimethylpropane-1,3-diol, 1,6-hexanediol, 1,7-heptanediol, 1,8-octanediol, 1,9-nonanediol, 1,10-decanediol, 1,12-dodecanediol, combinations thereof, and the like, including their structural isomers. The aliphatic diol may be, for example, selected in an amount of from about 40 to about 60 mole percent of the resin, from about 42 to about 55 mole percent of the resin, or from about 45 to about 53 mole percent of the resin, and a second diol may be selected in an amount of from about 0 to about 10 mole percent of the resin or from about 1 to 4 mole percent of the resin.

Examples of organic diacids or diesters including vinyl diacids or vinyl diesters selected for the preparation of crystalline resins include oxalic acid, succinic acid, glutaric acid, adipic acid, suberic acid, azelaic acid, sebacic acid, fumaric acid, dimethyl fumarate, dimethyl itaconate, cis-1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof. The organic diacid may be selected in an amount of, for example, from about 40 to about 60 mole percent of the resin, from about 42 to about 52 mole percent of the resin, or from about 45 to about 50 mole percent of the resin, and a second diacid can be selected in an amount of from about 0 to about 10 mole percent of the resin.

Polycondensation catalysts which may be utilized in forming crystalline (as well as amorphous) polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate), copoly(2,2-dimethylpropane-1,3-diol-decanoate)-copoly(nonylene-decanoate), poly(octylene-adipate), and mixtures thereof. Examples of polyamides include poly(ethylene-adipamide), poly(propylene-adipamide), poly(butylene-adipamide), poly(pentylene-adipamide), poly(hexylene-adipamide), poly(octylene-adipamide), poly(ethylene-succinimide), poly(propylene-sebecamide), and mixtures thereof. Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), poly(butylene-succinimide), and mixtures thereof.

In embodiments, the crystalline polyester is of the formula

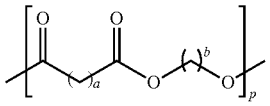

wherein each of a and b may range from 1 to 12, from 2 to 12, or from 4 to 12, and further wherein p may range from 10 to 100, from 20 to 80, or from 30 to 60. In embodiments, the crystalline polyester is poly(1,6-hexylene-1,12-dodecanoate), which may be generated by the reaction of dodecanedioc acid and 1,6-hexanediol.

The designation, "CX:CY," "CX:Y," "X:Y," and forms thereof as used herein describe crystalline resins, wherein C is carbon, X is a positive, non-zero integer identifying the number of methylene groups of the acid/ester monomer used to produce the crystalline polyester (CPE) and Y is a positive, non-zero integer identifying the number of methylene groups of the alcohol monomer used to produce the CPE. Thus, for example, C10 can represent, for example, a dodecanedioic acid and C6 can represent, for example, a hexanediol. X and Y each is 10 or lower. In embodiments, the sum of X and Y is 16 or lower. In certain embodiments, the sum and X and Y is 14 or lower.

In embodiments, the crystalline polyester is a C10:9 resin comprising polyester made from dodecanedioic acid (C10) and 1,9-nonanediol (C9).

As noted above, the crystalline polyesters may be prepared by a polycondensation process by reacting suitable organic diols and suitable organic diacids in the presence of polycondensation catalysts. A stoichiometric equimolar ratio of organic diol and organic diacid may be utilized, however, in some instances where the boiling point of the organic diol is from about 180° C. to about 230° C., an excess amount of diol, such as ethylene glycol or propylene glycol, of from about 0.2 to 1 mole equivalent, can be utilized and removed during the polycondensation process by distillation. The amount of catalyst utilized may vary, and can be selected in amounts, such as for example, from about 0.01 to about 1 or from about 0.1 to about 0.75 mole percent of the crystalline polyester resin.

The crystalline resin may be present in the toner in any suitable or desired amount. In embodiments, the crystalline resin may be present, for example, in an amount of from about 1% to about 85% by weight of the toner, from about 5% to about 50% by weight of the toner, or from about 10% to about 35% by weight of the toner. In certain embodiments, the crystalline polyester is present in an amount of from about 6 to about 7 percent by weight based upon the total weight of the toner composition. In certain embodiments, the crystalline polyester is a C10:9 resin which is present in the toner an amount of from about 6 to about 7 percent by weight based upon the total weight of the toner composition.

The crystalline resin can possess various melting points of, for example, from about 30° C. to about 120° C., from about 50° C. to about 90° C. or from about 60° C. to about 80° C. The crystalline resin may have a number average molecular weight (Mn), as measured by gel permeation chromatography (GPC) of, for example, from about 1,000 to about 50,000, from about 2,000 to about 25,000, or from about 5,000 to about 20,000, and a weight average molecular weight (Mw) of, for example, from about 2,000 to about 100,000, from about 3,000 to about 80,000, or from about 10,000 to about 30,000, as determined by GPC. The molecular weight distribution (Mw/Mn) of the crystalline resin may be, for example, from about 2 to about 6, from about 3 to 15 about 5, or from about 2 to about 4.

In embodiments, the toner comprises a core-shell configuration wherein the core comprises at least one amorphous polyester and at least one crystalline polyester; and wherein the shell comprises at least one amorphous polyester.

In other embodiments, the toner comprises a core-shell configuration wherein the core comprises at least one amorphous polyester and at least one crystalline polyester; and wherein the shell comprises a first amorphous polyester and a second amorphous polyester that is different from the first amorphous polyester.

In other embodiments, the toner comprises a core-shell configuration wherein the core comprises a first amorphous polyester comprising a poly(propoxylatedbisphenol-co-terephthalate-fumarate-dodecenylsuccinate) and a second amorphous polyester comprising a poly(propoxylated-ethoxylated bisphenol-co-terephthalate-dodecenylsuccinate-trimellitic anhydride).

In embodiments, the toner core further comprises a third amorphous polyester resin and a fourth amorphous polyester resin. In embodiments, the third and fourth amorphous polyester resin are different. In embodiments, the third amorphous polyester resin is present in an amount of from about 1 to about 20, or from about 3 to about 18, or from about 5 to about 15 percent by weight, based upon the total weight of the toner. In embodiments, the fourth amorphous polyester resin is present in an amount of from about 1 to about 20, or from about 3 to about 18, or from about 5 to about 15 percent by weight, based upon the total weight of the toner. In certain embodiments, the third amorphous polyester is a poly(propoxylated bisphenol-co-terephthalate-fumarate-dodecenylsuccinate) and the fourth amorphous polyester is a poly(propoxylated-ethoxylated bisphenol-co-terephthalate-dodecenylsuccinate-trimellitic anhydride).

In embodiments, the third amorphous polyester resin and the fourth amorphous polyester resin are present in the toner core in equal amounts.

In certain embodiments, the toner comprises a core-shell configuration wherein the shell comprises a resin and wherein the shell resin comprises about 28 percent by weight of the toner composition based upon the total weight of the toner composition including the core and shell. The shell resin or resins comprising the 28 percent of the toner can be selected from any of the resins described herein. In embodiments, the shell resin comprises 28 percent of the toner particle mass, in embodiments where the shell resin comprises a combination of two different amorphous polyesters, in embodiments, where the shell comprises a combination of a low molecular weight amorphous polyester and a high molecular weight amorphous polyester.

In embodiments, the amorphous resin may include at least one low molecular weight amorphous polyester resin. The low molecular weight amorphous polyester resins, which are available from a number of sources, can possess various melting points of, for example, from about 30° C. to about 120° C., in embodiments from about 75° C. to about 115° C., in embodiments from about 100° C. to about 110° C., or in embodiments from about 104° C. to about 108° C. As used herein, the low molecular weight amorphous polyester resin has, for example, a number average molecular weight (Mn), as measured by gel permeation chromatography (GPC) of, for example, from about 1,000 to about 10,000, in embodiments from about 2,000 to about 8,000, in embodiments from about 3,000 to about 7,000, and in embodiments from about 4,000 to about 6,000. The weight average molecular weight (Mw) of the resin is 50,000 or less, for example, in embodiments from about 2,000 to about 50,000, in embodiments from about 3,000 to about 40,000, in embodiments from about 10,000 to about 30,000, and in embodiments from about 18,000 to about 21,000, as determined by GPC using polystyrene standards. The molecular weight distribution (Mw/Mn) of the low molecular weight amorphous resin is, for example, from about 2 to about 6, in embodiments from about 3 to about 4. The low molecular weight amorphous polyester resins may have an acid value of from about 8 to about 20 mg KOH/g, in embodiments from about 9 to about 16 mg KOH/g, and in embodiments from about 10 to about 14 mg KOH/g.

In embodiments, a toner of the present disclosure may also include at least one high molecular weight branched or cross-linked amorphous polyester resin. This high molecular weight resin may include, in embodiments, for example, a branched amorphous resin or amorphous polyester, a cross-linked amorphous resin or amorphous polyester, or mixtures thereof, or a non-cross-linked amorphous polyester resin that has been subjected to cross-linking. In accordance with the present disclosure, from about 1% by weight to about 100% by weight of the high molecular weight amorphous polyester resin may be branched or cross-linked, in embodiments from about 2% by weight to about 50% by weight of the higher molecular weight amorphous polyester resin may be branched or cross-linked.

As used herein, the high molecular weight amorphous polyester resin may have, for example, a number average molecular weight (Mn), as measured by gel permeation chromatography (GPC) of, for example, from about 1,000 to about 10,000, in embodiments from about 2,000 to about 9,000, in embodiments from about 3,000 to about 8,000, and in embodiments from about 6,000 to about 7,000. The weight average molecular weight (Mw) of the resin is greater than 55,000, for example, from about 55,000 to about 150,000, in embodiments from about 60,000 to about 100,000, in embodiments from about 63,000 to about 94,000, and in embodiments from about 68,000 to about 85,000, as determined by GPC using polystyrene standard. The polydispersity index (PD) is above about 4, such as, for example, greater than about 4, in embodiments from about 4 to about 20, in embodiments from about 5 to about 10, and in embodiments from about 6 to about 8, as measured by GPC versus standard polystyrene reference resins. The PD index is the ratio of the weight-average molecular weight (Mw) and the number-average molecular weight (Mn). The low molecular weight amorphous polyester resins may have an acid value of from about 8 to about 20 mg KOH/g, in embodiments from about 9 to about 16 mg KOH/g, and in embodiments from about 11 to about 15 mg KOH/g. The high molecular weight amorphous polyester resins, which are available from a number of sources, can possess various melting points of, for example, from about 30° C. to about 140° C., in embodiments from about 75° C. to about 130° C., in embodiments from about 100° C. to about 125° C., and in embodiments from about 115° C. to about 121° C.

The high molecular weight amorphous resins, which are available from a number of sources, can possess various onset glass transition temperatures (Tg) of, for example, from about 40° C. to about 80° C., in embodiments from about 50° C. to about 70° C., and in embodiments from about 54° C. to about 68° C., as measured by differential scanning calorimetry (DSC). The linear and branched amorphous polyester resins, in embodiments, may be a saturated or unsaturated resin.

The high molecular weight amorphous polyester resins may be prepared by branching or cross-linking linear polyester resins. Branching agents can be utilized, such as trifunctional or multifunctional monomers, which agents usually increase the molecular weight and polydispersity of the polyester. Suitable branching agents include glycerol, trimethylol ethane, trimethylol propane, pentaerythritol, sorbitol, diglycerol, trimellitic acid, trimellitic anhydride, pyromellitic acid, pyromellitic anhydride, 1,2,4-cyclohexanetricarboxylic acid, 2,5,7-naphthalenetricarboxylic acid, 1,2,4-butanetricarboxylic acid, combinations thereof, and the like. These branching agents can be utilized in effective amounts of from about 0.1 mole percent to about 20 mole percent based on the starting diacid or diester used to make the resin.

Compositions containing modified polyester resins with a polybasic carboxylic acid which may be utilized in forming high molecular weight polyester resins include those disclosed in U.S. Pat. No. 3,681,106, as well as branched or cross-linked polyesters derived from polyvalent acids or alcohols as illustrated in U.S. Pat. Nos. 4,863,825; 4,863,824; 4,845,006; 5,143,809; 5,057,596; 4,988,794; 4,981,939; 4,980,448; 4,933,252; 4,931,370; 4,917,983, and 4,973,539, the disclosures of each of which are incorporated by reference herein in their entirety.

In embodiments, cross-linked polyesters resins may be made from linear amorphous polyester resins that contain sites of unsaturation that can react under free-radical conditions. Examples of such resins include those disclosed in U.S. Pat. Nos. 5,227,460; 5,376,494; 5,480,756; 5,500,324; 5,601,960; 5,629,121; 5,650,484; 5,750,909; 6,326,119; 6,358,657; 6,359,105; and 6,593,053, the disclosures of each of which are incorporated by reference herein in their entirety. In embodiments, suitable unsaturated polyester base resins may be prepared from diacids and/or anhydrides such as, for example, maleic anhydride, terephthalic acid, trimellitic acid, fumaric acid, and the like, and combinations thereof, and diols such as, for example, bisphenol-A ethylene oxide adducts, bisphenol A-propylene oxide adducts, and the like, and combinations thereof. In embodiments, a suitable polyester is poly(propoxylated bisphenol A co-fumaric acid).

In embodiments, a cross-linked branched polyester may be utilized as a high molecular weight amorphous polyester resin. Such polyester resins may be formed from at least two pre-gel compositions including at least one polyol having two or more hydroxyl groups or esters thereof, at least one aliphatic or aromatic polyfunctional acid or ester thereof, or a mixture thereof having at least three functional groups; and optionally at least one long chain aliphatic carboxylic acid or ester thereof, or aromatic monocarboxylic acid or ester thereof, or mixtures thereof. The two components may be reacted to substantial completion in separate reactors to produce, in a first reactor, a first composition including a pre-gel having carboxyl end groups, and in a second reactor, a second composition including a pre-gel having hydroxyl end groups. The two compositions may then be mixed to create a cross-linked branched polyester high molecular weight resin. Examples of such polyesters and methods for their synthesis include those disclosed in U.S. Pat. No. 6,592,913, the disclosure of which is hereby incorporated by reference herein in its entirety.

Suitable polyols may contain from about 2 to about 100 carbon atoms and have at least two or more hydroxyl groups, or esters thereof. Polyols may include glycerol, pentaerythritol, polyglycol, polyglycerol, and the like, or mixtures thereof. The polyol may include a glycerol. Suitable esters of glycerol include glycerol palmitate, glycerol sebacate, glycerol adipate, triacetin tripropionin, and the like. The polyol may be present in an amount of from about 20% to about 30% by weight of the reaction mixture, in embodiments, from about 22% to about 26% by weight of the reaction mixture.

Aliphatic polyfunctional acids having at least two functional groups may include saturated and unsaturated acids containing from about 2 to about 100 carbon atoms, or esters thereof, in some embodiments, from about 4 to about 20 carbon atoms. Other aliphatic polyfunctional acids include malonic, succinic, tartaric, malic, citric, fumaric, glutaric, adipic, pimelic, sebacic, suberic, azelaic, sebacic, and the like, or mixtures thereof. Other aliphatic polyfunctional acids which may be utilized include dicarboxylic acids containing a C3 to C6 cyclic structure and positional isomers thereof, and include cyclohexane dicarboxylic acid, cyclobutane dicarboxylic acid or cyclopropane dicarboxylic acid.

Aromatic polyfunctional acids having at least two functional groups which may be utilized include terephthalic, isophthalic, trimellitic, pyromellitic and naphthalene 1,4-, 2,3-, and 2,6-dicarboxylic acids.

The aliphatic polyfunctional acid or aromatic polyfunctional acid may be present in an amount of from about 40% to about 65% by weight of the reaction mixture, in embodiments, from about 44% to about 60% by weight of the reaction mixture.

Long chain aliphatic carboxylic acids or aromatic monocarboxylic acids may include those containing from about 12 to about 26 carbon atoms, or esters thereof, in embodiments, from about 14 to about 18 carbon atoms. Long chain aliphatic carboxylic acids may be saturated or unsaturated. Suitable saturated long chain aliphatic carboxylic acids may include lauric, myristic, palmitic, stearic, arachidic, cerotic, and the like, or combinations thereof. Suitable unsaturated long chain aliphatic carboxylic acids may include dodecylenic, palmitoleic, oleic, linoleic, linolenic, erucic, and the like, or combinations thereof. Aromatic monocarboxylic acids may include benzoic, naphthoic, and substituted naphthoic acids. Suitable substituted naphthoic acids may include naphthoic acids substituted with linear or branched alkyl groups containing from about 1 to about 6 carbon atoms such as 1-methyl-2 naphthoic acid and/or 2-isopropyl-1-naphthoic acid. The long chain aliphatic carboxylic acid or aromatic monocarboxylic acids may be present in an amount of from about 0% to about 70% weight of the reaction mixture, in embodiments, of from about 15% to about 30% weight of the reaction mixture.

Additional polyols, ionic species, oligomers, or derivatives thereof, may be used if desired. These additional glycols or polyols may be present in amounts of from about 0% to about 50% weight percent of the reaction mixture. Additional polyols or their derivatives thereof may include propylene glycol, 1,3-butanediol, 1,3-propanediol, 1,4-butanediol, 1,6-hexanediol diethylene glycol, 1,4-cyclohexanediol, 1,4-cyclohexanedimethanol, neopentyl glycol, triacetin, trimethylolpropane, pentaerythritol, cellulose ethers, cellulose esters, such as cellulose acetate, sucrose acetate iso-butyrate and the like.

In embodiments, the cross-linked branched polyesters for the high molecular weight amorphous polyester resin may include those resulting from the reaction of dimethylterephthalate, 1,3-butanediol, 1,2-propanediol, and pentaerythritol.

In embodiments, the high molecular weight resin, for example a branched polyester, may be present on the surface of toner particles of the present disclosure. The high molecular weight resin on the surface of the toner particles may also be particulate in nature, with high molecular weight resin particles having a diameter of from about 100 nanometers to about 300 nanometers, in embodiments from about 110 nanometers to about 150 nanometers.

The amount of high molecular weight amorphous polyester resin in a toner particle of the present disclosure, whether in any core, any shell, or both, may be from about 25% to about 50% by weight of the toner, in embodiments from about 30% to about 45% by weight, in other embodiments or from about 40% to about 43% by weight of the toner (that is, toner particles exclusive of external additives and water).

The ratio of crystalline resin to the low molecular weight amorphous resin to high molecular weight amorphous polyester resin can be in the range from about 1:1:98 to about 98:1:1 to about 1:98:1, in embodiments from about 1:5:5 to about 1:9:9, in embodiments from about 1:6:6 to about 1:8:8.

The resin(s) in the present toners may possess acid groups which may be present at the terminal of the resin. Acid groups which may be present include carboxylic acid groups, and the like. The number of carboxylic acid groups may be controlled by adjusting the materials utilized to form the resin and reaction conditions. In embodiments, the resin is a polyester resin having an acid number from about 2 mg KOH/g of resin to about 25 mg KOH/g of resin, from about 5 mg KOH/g of resin to about 20 mg KOH/g of resin, or from about 5 mg KOH/g of resin to about 15 mg KOH/g of resin. The acid containing resin may be dissolved in tetrahydrofuran solution. The acid number may be detected by titration with KOH/methanol solution containing phenolphthalein as the indicator. The acid number may then be calculated based on the equivalent amount of KOH/methanol required to neutralize all the acid groups on the resin identified as the end point of the titration.

Additional exemplary polymers that may be used for the toner resin include styrene acrylates, styrene butadienes, styrene methacrylates, and more specifically, poly(styrene-alkyl acrylate), poly(styrene-1,3-diene), poly(styrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly (styrene-butadiene), poly(methylstyrene-butadiene), poly (methyl methacrylate-butadiene), poly(ethyl methacrylate-butadiene), poly(propyl methacrylate-butadiene), poly (butylmethacrylate-butadiene), poly(methylacrylate-butadiene), poly(ethyl acrylate-butadiene), poly(propyl acrylate-butadiene), poly(butyl acrylate-butadiene), poly (styrene-isoprene), poly(methylstyrene-isoprene), poly (methyl methacrylate-isoprene), poly(ethyl methacrylate-isoprene), poly(propyl methacrylate-isoprene), poly(butylmethacrylate-isoprene), poly(methylacrylate-isoprene), poly (ethyl acrylate-isoprene), poly(propyl acrylate-isoprene), poly(butyl acrylate-isoprene), poly(styrene-propyl acrylate), poly(styrene-butyl acrylate), poly (styrene-butadiene-acrylic acid), poly(styrene-butadiene-methacrylic acid), poly (styrene-butadiene-acrylonitrile-acrylic acid), poly(styrene-butylacrylate-acrylicacid), poly(styrene-butylacrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymers may be block, random, or alternating copolymers.

In embodiments, the resin is selected from the group consisting of styrenes, acrylates, methacrylates, butadienes, isoprenes, acrylic acids, methacrylic acids, acrylonitriles, and combinations thereof.

In certain embodiments, the resin is selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly(styrene-isoprene), poly (methylstyrene-isoprene), poly(methylmethacrylate-isoprene), poly(ethyl methacrylate-isoprene), poly(propyl methacrylate-isoprene), poly(butyl methacrylateisoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and combinations thereof.

Coagulant.

The toners herein may also contain a coagulant, such as a monovalent metal coagulant, a divalent metal coagulant, a polyion coagulant, or the like. A variety of coagulants are known in the art. As used herein, "polyion coagulant" refers to a coagulant that is a salt or oxide, such as a metal salt or metal oxide, formed from a metal species having a valence of at least 3, and desirably at least 4 or 5. Suitable coagulants thus include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, and the like. Other suitable coagulants include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds, in embodiments, may have from about 2 to about 13, or from about 3 to about 8, aluminum ions present in the compound.

Such coagulants can be incorporated into the toner particles during particle aggregation. As such, the coagulant can be present in the toner particles, exclusive of external additives and on a dry weight basis, in amounts of from about 0 to about 5 percent, or from about greater than 0 to about 3 percent, by weight of the toner particles.

Surfactant.

In preparing the toner by the emulsion aggregation procedure, one or more surfactants may be used in the process. Suitable surfactants include anionic, cationic, and non-ionic surfactants. In embodiments, the use of anionic and non-ionic surfactants are preferred to help stabilize the aggregation process in the presence of the coagulant, which other could lead to aggregation instability.

Anionic surfactants include sodium dodecylsulfate (SDS), sodium dodecyl benzene sulfonate, sodium dodecylnaphthalene sulfate, dialkyl benzenealkyl sulfates and sulfonates, abietic acid, and the NEOGEN® brand of anionic surfactants. An example of a suitable anionic surfactant is NEOGEN® RK available from Daiichi Kogyo Seiyaku co. Ltd., or TAYCA POWER BN2060 from Tayca Corporation (Japan), which consists primarily of branched sodium dodecyl benzene sulphonate.

Examples of cationic surfactants include dialkyl benzene alkyl ammonium chloride, lauryl trimethyl ammonium chloride, alkylbenzyl methyl ammonium chloride, alkyl benzyl dimethyl ammonium bromide, benzalkonium chloride, ethyl pyridinium bromide, C12, C15, C17 trimethyl ammonium bromides, halide salts of quaternized polyoxyethylalkylamines, dodecyl benzyl triethyl ammonium chloride. MIRAPOL® and ALKAQUAT® available from Alkaril Chemical Company, SANISOL® (benzalkonium chloride) available from Kao Chemicals, and the like. An example of a suitable cationic surfactant is SANISOL® B-50 available from Kao Corp., which consists primarily of benzyl dimethyl alkonium chloride.

Examples of nonionic surfactants include polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxytheylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc Inc. as IGEPAL® CA-210, IGEPAL® CA-520, IGEPAL® CA-720, IGEPAL® CO-890, IGEPAL® CO-720, IGEPAL® CO-290, IGEPAL® CA-210, ANTAROX® 890 and ANTAROX® 897. An example of a suitable nonionic surfactant is ANTAROX® 897 available from Rhone-Poulenc Inc., which consists primarily of alkyl phenol ethoxylate.

Examples of bases used to increase the pH and hence ionize the aggregate particles thereby providing stability and preventing the aggregates from growing in size can be selected from sodium hydroxide, potassium hydroxide, ammonium hydroxide, cesium hydroxide, and the like, among others.

Examples of the acids that can be used include, for example, nitric acid, sulfuric acid, hydrochloric acid, acetic acid, citric acid, trifluro acetic acid, succinic acid, salicylic acid, and the like, and which acids are, in embodiments, used in a diluted form in the range of about 0.5 to about 10 weight percent by weight of water, or in the range of about 0.7 to about 5 weight percent by weight of water.

In embodiments, a naphthalene sulphonic acid polymeric surfactant is selected.

Optional Additives.

The toner particles can also contain other optional additives as desired.

For example, the toner can include positive or negative charge control agents in any desired or effective amount, in embodiments, in an amount of at least about 0.1 percent by weight of the toner, or at least about 1 percent by weight or the toner, or no more than about 10 percent by weight of the toner, or no more than about 3 percent by weight of the toner. Examples of suitable charge control agents include, but are not limited to, quaternary ammonium compounds such as alkyl pyridinium halides, bisulfates, alkyl pyridinium compounds, including those disclosed in U.S. Pat. No. 4,298,672, which is hereby incorporated by reference herein in its entirety; organic sulfate and sulfonate compositions, including those disclosed in U.S. Pat. No. 4,338,390, which is hereby incorporated by reference herein in its entirety; cetylpyridinium tetrafluoroborates; distearyl dimethyl ammonium methyl sulfate; aluminum salts such as BONTRON E84™ or E88™ (Hodogaya Chemical); and the like, as well as mixtures thereof. Such charge control agents can be applied simultaneously with the shell resin or after application of the shell resin.

There can also be blended with the toner particles external additive particles, including flow aid additives, which can be present on the surfaces of the toner particles. Examples of these additives include, but are not limited to, metal oxides, such as titanium oxide, silicon oxide, tin oxide, and the like, as well as mixtures thereof; colloidal and amorphous silicas, such as AEROSIL®, metal salts and metal salts of fatty acids including zinc stearate, aluminum oxides, cerium oxides, and the like, as well as mixtures thereof. Each of these external additives can be present in any desired or effective amount, in embodiments, in an amount of at least about 0.1 percent by weight of the toner, or at least about 0.25 percent by weight of the toner, or no more than about 5 percent by weight of the toner, or no more than about 3 percent by weight of the toner. Suitable additives include, but are not limited to, those disclosed in U.S. Pat. Nos. 3,590,000 and 6,214,507, each of which are hereby incorporated by reference herein in their entireties. These additives can be applied simultaneously with the shell resin or after application of the shell resin.

Emulsion aggregation polyester toners commonly employ about 7.2 parts per hundred (pph) TaycaPower B2060 surfactant, a sodium salt of dodecylbenzene sulphonate as the dispersant for NIPex® carbon black dispersion in the toner.

In embodiments, the amount of TaycaPower surfactant can be reduced in the pigment dispersion to only 2 pph, while adding 3.2 pph of DEMOL SN-B, which is a polymeric surfactant of butyl naphthalene sulfonic acid/2-naphthalene sulfonic acid/formaldehyde, sodium salt (Kao Corporation). The dispersion can then be used in making the toners.

Similar products can be used to reduce dielectric loss. For example: DEMOL M, a sodium arylsulfonate formaldehyde condensate powder, DEMOL SS-L, a sodium arylsulfonate formaldehyde condensate, DEMOL N, DEMOL RN, DEMOL T and DEMOL T-45 sodium naphthalene sulfonate formaldehyde condensates powder, DEMOL NL a sodium naphthalene sulfonate formaldehyde condensates liquid. Other manufacturers provide similar sulphonate formaldehyde condensates such as 1-Naphthalenesulfonic acid, formaldehyde polymer, sodium salt CAS NO. 32844-36-3 available from Anyang Double Circle Auxiliary Co., LTD (China) and sodium naphthalene sulfonate formaldehyde CAS NO. 9084-06-4 available from Chemtrade International (China).

Colorant.

The toners may optionally contain a colorant. Any suitable or desired colorant can be selected. In embodiments, the colorant can be a pigment, a dye, mixtures of pigments and dyes, mixtures of pigments, mixtures of dyes, and the like. For simplicity, the term "colorant" when used herein is meant to encompass such colorants, dyes, pigments, and mixtures unless specified as a particular pigment or other colorant component. In embodiments, the colorant comprises a pigment, a dye, mixtures thereof, in embodiments, carbon black, magnetite, black, cyan, magenta, yellow, red, green, blue, brown, mixtures thereof, in an amount of from about 1 percent to about 25 percent by weight based upon the total weight of the toner composition. In embodiments, the colorant is selected from cyan, magenta, yellow, black, or a combination thereof. In certain embodiments, the colorant comprises a combination of carbon black and cyan. It is to be understood that other useful colorants will become readily apparent based on the present disclosure.

In certain embodiments, the colorant comprises pigment present in an amount of from about 5 to about 8 percent by weight based upon the total weight of the toner composition.

Useful colorants include Paliogen® Violet 5100 and 5890 (BASF), Normandy Magenta RD-2400 (Paul Uhlrich), Permanent Violet VT2645 (Paul Uhlrich), Heliogen® Green L8730 (BASF), Argyle Green XP-111-S (Paul Uhlrich), Brilliant Green Toner GR 0991 (Paul Uhlrich), Lithol® Scarlet D3700 (BASF), Toluidine Red (Aldrich), Scarlet for Thermoplast NSD Red (Aldrich), Lithol® Rubine Toner (Paul Uhlrich), Lithol® Scarlet 4440, NBD 3700 (BASF), Bon Red C (Dominion Color), Royal Brilliant Red RD-8192 (Paul Uhlrich), Oracet® Pink RF (Ciba Geigy), Paliogen® Red 3340 and 3871K (BASF), Lithol® Fast Scarlet L4300 (BASF), Heliogen® Blue D6840, D7080, K7090, K6910, and L7020 (BASF), Sudan Blue OS (BASF), Neopen® Blue FF4012 (BASF), PV Fast Blue B2G01 (American Hoechst), Irgalite® Blue BCA (Ciba Geigy), Paliogen® Blue6470

(BASF), Sudan II, III, and IV (Matheson, Coleman, Bell), Sudan Orange (Aldrich), Sudan Orane 220 (BASF), Paliogen® Orange 3040 (BASF), Ortho Orange OR 2673 (Paul Uhlrich), Paliogen® Yellow 152 and 1560 (BASF), Lithol® Fast Yellow 0991K (BASF), Paliotol® Yellow 1840 (BASF), Novaperm® Yellow FGL (Hoechst), Permanent Yellow YE 0305 (Paul Uhlrich), Lumogen® Yellow 00790 (BASF), Suco-Gelb 1250 (BASF), Suco-Yellow D1355 (BASF), Suco Fast Yellow D1165, D1355, and D1351 (BASF), Hostaperm® Pink E (Hoechst), Fanal® Pink D4830 (BASF), Cinquasia® Magenta (DuPont), Paliogen® BlackL9984 (BASF), Pigment Black K801 (BASF), and particularly carbon blacks such as REGAL® 330 (Cabot), Carbon Black 5250 and 5750 (Columbian Chemicals), and the like, or mixtures thereof.

Additional useful colorants include pigments in water based dispersions such as those commercially available from Sun Chemical, for example, SUNSPERSE® BHD 6011X (Blue 15 Type), SUNSPERSE® BHD 9312X (Pigment Blue 15 74160), SUNSPERSE® BHD 6000X (Pigment Blue 15:3 74160), SUNSPERSE® GHD 9600X and GHD 6004X (Pigment Green 7 74260), SUNSPERSE® QHD 6040 X (Pigment Red 122 73915), SUNSPERSE® RHD 9668X (Pigment Red 185 12516), SUNSPERSE® RHD 9365X and 9504X (Pigment Red 57 15850:1), SUNSPERSE® YHD 6005X (Pigment Yellow 83 21108), FLEXIVERSE® YFD 4249 (Pigment Yellow 17 21105), SUNSPERSE® YHD 6020X and 6045X (Pigment Yellow 74 11741), SUNSPERSE® YHD 600X and 9604X (Pigment Yellow 14 21095), FLEXIVERSE® LFD 4343 and LFD 9736 (Pigment Black 7 77226), and the like, or mixtures thereof. Other useful water based colorant dispersions include those commercially available from Clariant, for example, HOSTAFINE® Yellow GR, HOSTAFINE® Black T and Black TS, HOSTAFINE® Blue B2G, HOSTAFINE® Rubine F6B, and magenta dry pigment such as Toner Magenta 6BVP2213 and Toner Magenta E02 which can be dispersed in water and/or surfactant prior to use.

Other useful colorants include magnetites, such as Mobay magnetites M08029, M98960, Columbian magnetites, MAPICO® BLACKS, and surface treated magnetites; Pfizer magnetites CB4799, CB5300, CB5600, MXC6369, Bayer magnetites, BAYFERROX® 8600, 8610; Northern Pigments magnetites, NP-604, NP-608; Magnox magnetites TMB-100 or TMB-104; and the like or mixtures thereof. Additional examples of pigments include phthalocyanine HELIOGEN® BLUE L6900, D6840, D7080, D7020, PYLAM® OIL BLUE, PYLAM® OIL YELLOW, PIGMENT BLUE 1 available from Paul Uhlrich & Company, Inc., PIGMENT VIOLET 1, PIGMENT RED 48, LEMON CHROME YELLOW DCC 1026, ED. TOLUIDINE RED, AND BON RED C available from Dominion Color Corporation, Ltd., Toronto, Ontario, NOVAPERM® YELLOW FGL, HOSTAPERM® PINK E from Hoechst, and CINQUASIA® MAGENTA (DuPont), and the like. Examples of magentas include 2,9-dimethyl substituted quinacridone and anthraquinone dye identified in the Color Index as CI 60710, CI Dispersed Red 15, diazo dye identified in the Color Index as CI 26050, CI Solvent Red 19, and the like, or mixtures thereof. Examples of cyans include copper tetra(octadecyl sulfonamide) phthalocyanine, x-copper phthalocyanine pigment listed in the Color Index as CI 74160, CI Pigment Blue, and Anthrathrene Blue identified in the Color Index as DI 69810, Special Blue X-2137, and the like, or mixtures thereof. Illustrative examples of yellows that may be selected include diarylide yellow 3,3-dichlorobenzidene acetoacetanilides, a monoazo pigment identified in the Color Index ad CI 12700, CT Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,4-dimethoxy acetoacetanilide, and Permanent Yellow FGL. Colored magnetites, such as mixtures of MAPICO® BLACK and cyan components may also be selected as pigments.

The colorant, such as carbon black, cyan, magenta, and/or yellow colorant, is incorporated in an amount sufficient to impart the desired color to the toner. In general, pigment or dye is employed in an amount of from about 1 percent to about 35 percent, or from about 5 percent to about 25 percent, or from about 5 percent to about 15 percent, by weight of the toner particles on a solids basis. However, amounts outside of these ranges can also be used.

In embodiments, the toner includes a carbon black colorant. Certain emulsion aggregation toners include NIPex® 35 a non-oxidized, low structure furnace black, while other emulsion aggregation toners use Regal® 330. In order to enable as low as possible dielectric loss, a low conductivity carbon black such as the NIPex® 35 is selected. Since carbon black is a semi-conductor, it is desirable to keep the carbon black as pure as possible. Heteroatoms such as oxygen and sulfur dope the carbon black semi-conductor, increasing the conductivity. NIPex® 35 has very high carbon content on the surface as determined by XPS, >99.5%, and very low At % of O and S, <0.5% total. Since the carbon black is very pure, and has very little of the very strong dopants oxygen and sulfur on the surface, the conductivity is very low. This provides lower dielectric loss than with a less pure carbon black, such as Regal® 330, which has >1% oxygen and sulfur. The difference in the purity is most dramatically shown by the carbon:oxygen ratio of the carbon black, which is 499:1 for NIPex® 35, compared to 139:1 for Regal® 330.

In embodiments, the colorant comprises a combination of carbon black and cyan, in embodiments, cyan PB 15:3.

In embodiments, the toner comprises 5 to 8 percent by weight pigment. In certain embodiments, the toner comprises 5 to 8 percent by weight pigment, wherein the pigment comprises a combination of carbon black and cyan, 73 to 78 percent by weight amorphous polyester, wherein the amorphous polyester comprises a first amorphous polyester and a second amorphous polyester that is different from the first amorphous polyester, 6 to 7 percent by weight crystalline polyester, in embodiments wherein the crystalline polyester is a C10:C9 crystalline polyester, where percent by weight is based on the total weight of the toner compositions. In embodiments, the toner comprises a cyan pigment present at about 1 percent by weight and a carbon black pigment present in an amount of about 6.9 percent by weight, based upon the total weight of the toner composition.

In other embodiments, the toner comprises a colorant comprising a combination of two or more of cyan, in embodiments cyan PB 15:3, magenta, in embodiments, one or both of magenta PR269 and magenta RE05, yellow, in embodiments, yellow PY74, and carbon black. In other embodiments, the toner comprises 5 to 8 percent pigment comprising a combination of two or more of cyan, in embodiments cyan PB 15:3, magenta, in embodiments, one or both of magenta PR269 and magenta RE05, yellow, in embodiments, yellow PY74, and carbon black.

Waxes.

Optionally, a wax may also be combined with the resin in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 500 to about 20,000, in embodiments from about 1,000 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™ POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

In certain embodiments, the toner herein may be a dual wax toner as described in U.S. patent application Ser. No. 16/800,176, which is hereby incorporated by reference herein in its entirety. In embodiments, the toner composition comprises a first wax; a second wax that is different from the first wax; wherein the first wax comprises a paraffin wax; wherein the second wax comprises a polymethylene wax; at least one polyester; and an optional colorant.

Surface Additive Formulation.

In embodiments, the toner herein includes a parent toner particle comprising at least one resin, in combination with an optional colorant, and an optional wax. The resin, colorant, and wax can be selected from those described herein. In embodiments, the toner includes a surface additive formulation provided on the parent toner particle, the surface additive formulation comprising at least one medium silica surface additive having an average primary particle diameter of 30 to 50 nanometers, the at least one medium silica provided at a surface area coverage of 40 to 100 percent of the parent toner particle surface area; at least one large cross-linked organic polymeric additive having an average primary particle diameter of 75 to 120 nanometers, the at least one large cross-linked organic polymeric additive provided at a surface area coverage of 5 to 29 percent of the parent toner particle surface area; at least one positive charging surface additive, wherein the at least one positive charging surface additive is: (a) a titanium dioxide surface additive having an average primary particle size of 15 to 40 nanometers, the titanium dioxide present in an amount of less than or equal to 1 part per hundred based on 100 parts of the parent toner particles; and wherein the parent toner particles further contain a small silica having an average primary particle diameter of 8 to 16 nanometers, the small silica present at a surface area coverage of 5 to 75 percent of the parent toner particle surface area; or (b) a non-titanium dioxide positive charging metal oxide surface additive, wherein the non-titanium dioxide positive charging metal oxide surface additive has an average primary particle size of 8 to 30 nanometers, and wherein the non-titanium dioxide positive charging metal oxide surface additive is present at a surface area coverage of 5 to 15 percent of the parent toner particle surface area; and wherein the parent toner particles further optionally contain a small silica having an average primary particle diameter of 8 to 16 nanometers, the small silica present at a surface area coverage of 0 to 75 percent of the parent toner particle surface area; wherein a total surface area coverage of all of the surface additives combined is 100 to 140 percent of the parent toner particle surface area. In embodiments, (b) a non-titanium dioxide positive charging metal oxide surface additive, has a volume average primary particle size of 8 to 30 nanometers, or 8 to 25 nanometers, or 8 to 21 nanometers. Average primary particle diameter is a volume D50 diameter measured by the additive manufacturer or vendor. Methods of measuring particle diameter are SEM (Scanning Electron Microscopy) or TEM (Transmission Electron Microscopy). In some cases indirect methods such as dynamic light scattering DLS can be used. Examples of DLS equipment that is suitable includes the Nanotrac Wave and Nanotrac Wave II.

In embodiments, the percent surface area coverage (SAC) of an additive with respect to the toner parent particles can be calculated as $$SAC=100\cdot(w\cdot D\cdot P)/(0.363\cdot d\cdot p)$$

wherein, for the toner parent particle, D is the D50 volume average size in microns and P is the true bulk density in grams/cm$^3$; and wherein, for the toner surface additive, d is the D50 volume average particle size in nanometers, p is the true bulk density is grams/cm$^3$, and w is the weight of the toner surface additive added to the mixture in parts per hundred based on the toner parent particle.

A medium silica as used herein means a silica having an average volume primary particle diameter of 30 to 50 nanometers.

In embodiments, the medium silica has a hydrophobic treatment thereon. In embodiments, the hydrophobic treatment comprises polydimethylsiloxane (HMDS). In embodiments, the hydrophobic treatment comprises an alkyl silane, such as hexamethyldisilazane (HMDS). The medium silica can be a medium treated fumed silica such as those available under the trade name Wacker HDK® HO5TD (40 nm, PDMS), HDK® HO5™ (40 nm, HMDS), HDK® HO5TX (40 nm, HMDS/PDMS); Evonik NY50 (30 nm, PDMS), NAX50 (30 nm, HMDS), RY50 (40 nm, PDMS), and RX50 (40 nm, HMDS).

Where the parent toner particle has a total surface area of 100 percent, the medium silica, in embodiments, is provided at a surface area coverage of 40 to 100 percent of the parent toner particle surface area.

In certain embodiments, the at least one medium silica comprises two or more medium silicas, wherein the two or more medium silicas comprise surface-treated medium silican selected from the group consisting of an alkyl silane treated silica, a polydimethysiloxane treated silica, and combinations thereof.

In certain embodiments, the at least one medium silica comprises a first medium silica that is an alkyl silane treated silica and a second medium silica that is a polydimethylsiloxane treated silica.

The surface additive formulation includes at least one at least one large cross-linked organic polymeric additive having an average primary particle diameter of 75 to 120 nanometers, the at least one large cross-linked organic polymeric additive provided at a surface area coverage of 5 to 29 percent of the parent toner particle surface area.

A large cross-linked organic polymeric additive as used herein means a cross-linked organic polymeric additive having a volume average primary particle diameter of 75 to 120 nanometers, or 80 to 120 nanometers.

Where the parent toner particle has a total surface area of 100 percent, the large cross-linked organic polymeric additive, in embodiments, is provided at a surface area coverage of 5 to 29 percent, or 5 to 15 percent of the parent toner particle surface area.

In embodiments, the large cross-linked organic polymeric additive is a highly cross-linked polymeric additive. In embodiments, the large cross-linked organic polymeric additive is a copolymer comprising a first monomer having a high carbon to oxygen ratio of from about 3 to about 8; and a second monomer comprising two or more vinyl groups, wherein the second monomer is present in the copolymer in an amount of from greater than about 8 percent by weight to about 60 percent by weight, based on the weight of the copolymer. In embodiments, the copolymer further comprises a third monomer comprising an amine, wherein the third monomer is present in an amount of from about 0.5 percent by weight to about 5 percent by weight, based on the weight of the copolymer.

The large cross-linked organic polymeric additive, also termed herein a polymeric toner additive or a copolymer or copolymer toner additive, in embodiments, is a latex formed using emulsion polymerization. The latex includes at least one monomer with a high carbon to oxygen (C/O) ratio combined with a monomer possessing two or more vinyl groups, combined with a monomer containing an amine functionality. The aqueous latex is then dried and can be used in place of, or in conjunction with, other toner additives. The use of a high C/O ratio monomer provides good relative humidity (RH) stability, and the use of the amine functional monomer provides desirable charge control for the resulting toner composition. The use of a monomer possessing two or more vinyl groups, sometimes referred to herein, in embodiments, as a crosslinking monomer or a crosslinking vinyl monomer, provides a crosslinked property to the polymer, thereby providing mechanical robustness required in the developer housing. For further detail, see U.S. patent application Ser. No. 16/369,013, which is hereby incorporated by reference herein in its entirety. For further detail, see also U.S. patent application Ser. No. 16/369,126, which is hereby incorporated by reference herein in its entirety.

As used herein, a polymer or co-polymer is defined by the monomer(s) from which a polymer is made. Thus, for example, while in a polymer made using an acrylate monomer as a monomer reagent, an acrylate moiety per se no longer exists because of the polymerization reaction, as used herein, that polymer is said to comprise the acrylate monomer. Thus, an organic polymeric additive made by a process disclosed herein can be prepared, for example, by the polymerization of monomers including cyclohexyl methacrylate, divinyl benzene, and dimethylaminoethylmethacrylate. The resulting organic polymeric additive can be said to comprise cyclohexyl methacrylate as that monomer was used to make the organic polymeric additive; can be said to be composed of or as comprising divinyl benzene as divinyl benzene is a monomer reagent of that polymer; and so on. Hence, a polymer is defined herein based on one or more of the component monomer reagents, which provides a means to name the organic polymeric additives herein.

As noted above, the polymeric additive may be in a latex. In embodiments, a latex copolymer utilized as the polymeric surface additive may include a first monomer having a high C/O ratio, such as an acrylate or a methacrylate. The C/O ratio of such a monomer may be from about 3 to about 8, in embodiments, from about 4 to about 7, or from about 5 to about 6. In embodiments, the monomer having a high C/O ratio may be an aliphatic cycloacrylate. Suitable aliphatic cycloacrylates which may be utilized in forming the polymer additive include, for example, cyclohexyl methacrylate, cyclopropyl acrylate, cyclobutyl acrylate, cyclopentyl acrylate, cyclohexyl acrylate, cyclopropyl methacrylate, cyclobutyl methacrylate, cyclopentyl methacrylate, isobornyl methacrylate, isobornyl acrylate, benzyl methacrylate, phenyl methacrylate, combinations thereof, and the like.

The first monomer having a high carbon to oxygen ratio, in embodiments, a cycloacrylate, may be present in the copolymer utilized as a polymeric additive in any suitable or desired amount. In embodiments, the cycloacrylate may be present in the copolymer in an amount of from about 40 percent by weight of the copolymer to about 99.4 percent by weight of the copolymer, or from about 50 percent by weight of the copolymer to about 95 percent by weight of the copolymer, or from about 60 percent by weight of the copolymer to about 95 percent by weight of the copolymer. In embodiments, the first monomer is present in the copolymer in an amount of from about 40 percent by weight to about 90 percent by weight, based on the weight of the copolymer, or from about 45 percent by weight to about 90 percent by weight, based on the weight of the copolymer.

The copolymer toner additive also includes second monomer, wherein the second monomer comprises a crosslinking monomer, in embodiments, the second monomer comprises a crosslinking monomer possessing vinyl groups, in certain embodiments, two or more vinyl groups.

Suitable monomers having vinyl groups for use as the crosslinking vinyl containing monomer include, for example, diethyleneglycol diacrylate, triethyleneglycol diacrylate, tetraethyleneglycol diacrylate, polyethyleneglycol diacrylate, 1,6-hexanediol diacrylate, neopentylglycol diacrylate, tripropyleneglycol diacrylate, polypropyleneglycol diacrylate, 2,2'-bis(4-(acryloxy/diethoxy)phenyl)propane, trimethylolpropane triacrylate, tetramethylolmethane tetraacrylate, ethyleneglycol dimethacrylate, diethyleneglycol dimethacrylate, triethyleneglycol dimethacrylate, tetraethyleneglycol dimethacrylate, polyethyleneglycol dimethacrylate, 1,3-butyleneglycol dimethacrylate, 1,6-hexanediol dimethacrylate, neopentylglycol dimethacrylate, polypropyleneglycol dimethacrylate, 2,2',-bis(4-(methacryloxy/diethoxy)phenyl)propane, 2,2'-bis(4-(methacryloxy/polyethoxy)phenyl)propane, trimethylolpropane trimethacrylate, tetramethylolmethane tetramethacrylate, divinyl benzene, divinyl naphthalene, divinyl ether, combinations thereof, and the like. In a specific embodiment, the cross-linking monomer is divinyl benzene.

The copolymer toner additive herein comprises a second monomer which results in the copolymer toner additive being a highly crosslinked copolymer. In embodiments, the second monomer comprising two or more vinyl groups is present in the copolymer in an amount of greater than about 8 percent by weight to about 60 percent by weight, based upon the weight of the copolymer, or greater than about 10 percent by weight to about 60 percent by weight, based upon the weight of the copolymer, or greater than about 20 percent by weight to about 60 percent by weight, based upon the weight of the copolymer, or greater than about 30 percent by weight to about 60 percent by weight, based upon the weight of the copolymer. In certain embodiments, the second monomer is present in the copolymer in an amount of greater than about 40 percent by weight to about 60 percent by weight, or greater than about 45 percent by weight to about 60 percent by weight, based on the weight of the copolymer.

The copolymer herein optionally further comprises a third monomer comprising an amine functionality. Monomers possessing an amine functionality may be derived from acrylates, methacrylates, combinations thereof, and the like. In embodiments, suitable amine-functional monomers include dimethylaminoethyl methacrylate (DMAEMA), diethylaminoethyl methacrylate, dipropylaminoethyl methacrylate, diisopropylaminoethyl methacrylate, dibutylaminoethyl methacrylate, combinations thereof, and the like.

In embodiments, the copolymer herein does not contain the third monomer. In other embodiments, the copolymer herein contains the third monomer comprising an amine-functional monomer. The amine-functional monomer, if present, may be present in the a copolymer in an amount of from about 0.1 percent by weight of the copolymer to about 40 percent by weight of the copolymer, or from about 0.5 percent by weight of the copolymer to about 5 percent by weight of the copolymer, or from about 0.5 percent by weight of the copolymer to about 1.5 percent by weight of the copolymer.

In embodiments, the copolymer additive comprises cyclohexyl methacrylate as a hydrophobic monomer and divinyl benzene as a cross-linkable monomer. In certain embodiments, the copolymer additive comprises cyclohexyl methacrylate as a hydrophobic monomer, divinyl benzene as a cross-linkable monomer, and dimethylaminoethyl methacrylate as a nitrogen-containing monomer.

Methods for forming the copolymer toner surface additive are within the purview of those skilled in the art and include, in embodiments, emulsion polymerization of the monomers utilized to form the polymeric additive.

In the polymerization process, the reactants may be added to a suitable reactor, such as a mixing vessel. The appropriate amount of starting materials may be optionally dissolved in a solvent, an optional initiator may be added to the solution, and contacted with at least one surfactant to form an emulsion. A copolymer may be formed in the emulsion (latex), which may then be recovered and used as the polymeric additive for a toner composition.

Where utilized, suitable solvents include, but are not limited to, water and/or organic solvents including toluene, benzene, xylene, tetrahydrofuran, acetone, acetonitrile, carbon tetrachloride, chlorobenzene, cyclohexane, diethyl ether, dimethyl ether, dimethyl formamide, heptane, hexane, methylene chloride, pentane, combinations thereof, and the like.

In embodiments, the latex for forming the polymeric additive may be prepared in an aqueous phase containing a surfactant or co-surfactant, optionally under an inert gas such as nitrogen. Surfactants which may be utilized with the resin to form a latex dispersion can be ionic or nonionic surfactants in an amount of from about 0.01 to about 15 weight percent of the solids, and in embodiments of from about 0.1 to about 10 weight percent of the solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™ NEOGEN SC™ obtained from Daiichi Kogyo Seiyaku Co., Ltd., combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quartenized polyoxyethylalkylamines, dodecylbenzyl triethyl ammonium chloride, MIRAPOL® and ALKAQUAT® available from Alkaril Chemical Company, SANISOL (benzalkonium chloride), available from Kao Chemicals, combinations thereof, and the like. In embodiments a suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxyl ethyl cellulose, carboxymethyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, combinations thereof, and the like.

In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be utilized.

The choice of particular surfactants or combinations thereof, as well as the amounts of each to be used, are within the purview of those skilled in the art.

In embodiments initiators may be added for formation of the latex utilized in formation of the polymeric additive. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2,-azobis propanenitrile, VAZO 88™, 2-2'-azobis isobutyramide dehydrate, and combinations thereof. Other water-soluble initiators which may be utilized include azoamidine compounds, for example 2,2',-azobis(2-methyl-N-phenylpropionamidine) dihydrochloride, 2,2'-azobis[N-(4-chlorophenyl)-2-methylpropionamidine] di-hydrochloride, 2,2',-azobis[N-(4-hydroxyphenyl)-2-methyl-propionamidine]dihydrochloride, 2,2',-azobis[N-(4-amino-phenyl)-2-methylpropionamidine] tetrahydrochloride, 2,2',-azobis[2-methyl-N(phenylmethyl) propionamidine]dihydrochloride, 2,2',-azobis[2-methyl-N-2-propenylpropionamidinedihydrochloride, 2,2',-azobis[N-(2-hydroxy-ethyl)2-methylpropionamidine] dihydrochloride, 2,2'-azobis[2(5-methyl-2-imidazolin-2-yl) propane]dihydrochloride, 2,2',-azobis[2-(2-imidazolin-2-yl) propane]dihydrochloride, 2,2'-azobis[2-(4,5,6,7-tetrahydro-1H-1,3-diazepin-2-yl)propane]dihydrochloride, 2,2,-azobis [2-(3,4,5,6-tetrahydropyrimidin-2-yl)propane] dihydrochloride, 2,2',-azobis[2-(5-hydroxy-3,4,5,6-tetrahydropyrimidin-2-yl)propane]dihydrochloride, 2,2',-azobis{2-[1-(2-hydroxyethyl)-2-imidazolin-2-yl] propane}dihydrochloride, combinations thereof, and the like.

Initiators can be added in suitable amounts, such as from about 0.1 to about 8 weight percent, or from about 0.2 to about 5 weight percent, of the monomers.

In forming the emulsions, the starting materials, surfactant, optional solvent, and optional initiator may be combined utilizing any means within the purview of those skilled in the art. In embodiments, the reaction mixture may be mixed for from about 1 minute to about 72 hours, in embodiments from about 4 hours to about 24 hours, while keeping the temperature at from about 10° C. to about 100° C., or from about 20° C. to about 90° C., or from about 45° C. to about 75° C.

Those skilled in the art will recognize that optimization of reaction conditions, temperature, and initiator loading can be varied to generate polymers of various molecular weights, and that structurally related starting materials may be polymerized using comparable techniques.

The resulting latex, possessing the polymeric additive of the present disclosure, may have a C/O ratio of from about 3 to about 8, in embodiments from about 4 to about 7.

The resulting latex, possessing the polymeric additive of the present disclosure, may be applied to toner particles utilizing any means within the purview of one skilled in the art. In embodiments, the toner particles may be dipped in or sprayed with the latex including the polymeric additive, thus becoming coated therewith, and the coated particles may then be dried to leave the polymeric coating thereon.

In other embodiments, once the copolymer utilized as the additive for a toner has been formed, it may be recovered from the latex by any technique within the purview of those skilled in the art, including filtration, drying, centrifugation, spray draying, combinations thereof, and the like.

In embodiments, once obtained, the copolymer utilized as the additive for a toner may be dried to powder form by any method within the purview of those skilled in the art, including, for example, freeze drying, optionally in a vacuum, spray drying, combinations thereof, and the like. The dried polymeric additive of the present disclosure may then be applied to toner particles utilizing any means within the purview of those skilled in the art including, but not limited to, mechanical impaction and/or electrostatic attraction.

Particles of the copolymer may have an average or medium particle size (d50) of from about 70 nanometers to about 250 nanometers in diameter, or from about 80 nanometers to about 200 nanometers in diameter, or from about 80 to about 120 nanometers, or from about 80 to about 115 nanometers. Advantageously, the teachings of the present disclosure render it easier to arrive at the desired particle size, in embodiments, a copolymer size as described herein.

The copolymers utilized as the polymeric additive, in embodiments, are not soluble in solvents such as tetrahydrofuran (THF) due to their highly cross-linked nature. Thus, it is not possible to measure a number average molecular weight (Mn) or a weight average molecular weight (Mw), as measured by gel permeation chromatography (GPC).

The copolymers utilized as the polymeric additive may have a glass transition temperature (Tg) of from about 85° C. to about 140° C., in embodiments from about 100° C. to about 130° C. In embodiments, A-zone charge of a toner including the polymeric additive of the present disclosure may be from about −15 to about −80 microcolombs per gram, in embodiments from about −20 to about −60 microcolombs per gram, while J-zone charge of a toner including the polymeric additive of the present disclosure may be from about −15 to about −80 microcolombs per gram, in embodiments from about −20 to about −60 microcolombs per gram.

The polymeric composition of the present disclosure may be combined with toner particles so that the polymeric composition is present in any suitable or desired amount, in embodiments, in an amount of from about 0.1 percent to about 5 percent by weight, or from about 0.2 percent to about 4 percent by weight, or from about 0.5 percent to about 1.5 percent by weight, based upon the weight of the toner particles. In embodiments, the polymeric composition is provided to cover from about 5 to about 29 percent of the surface area of the toner particles, or from about 5 percent to about 15 percent of the surface area of the toner particles. In embodiments, the polymeric composition is provided to cover from about 10 to about 30 percent of the surface area of the toner particles.

The polymeric additives thus produced may be combined with toner resins, optionally possessing colorants, to form a toner of the present disclosure.

The surface additive formulation includes at least one positive charging surface additive.

In embodiments, the surface additive formulation includes at least one positive charging surface additive which is: (a) a titanium dioxide surface additive having a volume average primary particle size of 15 to 40 nanometers, the titanium dioxide present in an amount of less than or equal to 1 part per hundred based on 100 parts of the parent toner particles; and wherein the parent toner particles further contains a small silica having a volume average primary particle diameter of 8 to 16 nanometers, the small silica present at a surface area coverage of 5 to 75 percent of the parent toner particle surface area; or (b) a non-titanium dioxide positive charging metal oxide surface additive, wherein the non-titanium dioxide positive charging metal oxide surface additive has a volume average primary particle size of 8 to 30 nanometers, and wherein the non-titanium dioxide positive charging metal oxide surface additive is present at a surface area coverage of 5 to 15 percent of the parent toner particle surface area; and wherein the parent toner particles further optionally contain a small silica having a volume average primary particle diameter of 8 to 16 nanometers, the small silica present at a surface area coverage of 0 to 75 percent of the parent toner particle surface area. In embodiments, the non-titanium dioxide positive charging metal oxide surface additive is a metal oxide comprising at least one member of the group consisting of a Bronsted base, a Lewis base, and an amphoteric compound.

In embodiments, the toner surface additive formulation is free of titanium dioxide, that is, does not contain titanium dioxide, or contains a reduced amount of titanium dioxide over prior known toner additive formulations. In embodiments, the toner additive formulation includes a titanium dioxide surface additive having an average primary particle size of 15 to 40 nanometers, the titanium dioxide present in an amount of less than or equal to 1 part per hundred based on 100 parts of the parent toner particles. In this embodiment, the toner additive formulation may further include a small silica having an average primary particle diameter of 8 to 16 nanometers, the small silica present at a surface area coverage of 5 to 75 percent of the parent toner particle surface area.

The titanium dioxide may be selected from any suitable or desired titanium dioxide having the desired particle size, such as JMT-150IB from Tayca Corp., having a volume average particle diameter of 15 nanometers, JMT2000 from Tayca Corp., having particle dimensions of 15×15×40 nanometers, T805 from Evonik having a volume average particle diameter of about 21 nanometers, SMT5103 from Tayca Corporation having a particle size of about 40 nanometers, and STT-100H from Inabata America Corporation of average size of about 40 nanometers. See U.S. Pat. Nos. 8,163,450, 8,916,317, 8,507,166, and 7,300,734, each of which is hereby incorporated by reference herein in entirety.

A small silica as used herein means a silica having an average volume primary particle diameter of 8 to 16 nanometers.

Where the parent toner particle has a total surface area of 100 percent, the small silica, in embodiments, is provided at a surface area coverage of 0 to 75 percent of the parent toner particle surface area, or, in embodiments, 5 to 75 percent of the parent toner particle surface area, or 30 to 75 percent of the parent toner particle surface area.

The small silica may be selected from any suitable or desired silica having the desired particle size, such as RY200L available from Evonik Industries. In embodiments, the small silica is selected from the group consisting of alkyl silane treated silica, polydimethylsiloxane treated silica, and combinations thereof. In embodiments, the small silica includes treated silicas Wacker HDK® H13TD (16 nm, PDMS), HDK® H13TM (16 nm, HMDS), HDK® H13TX (16 nm, HMDS/PDMS), HDK® H20TD (12 nm, PDMS), HDK® H20TM (12 nm, HMDS), HDK® H20TX (12 nm, HMDS/PDMS), HDK® H30TD (8 nm, PDMS), HDK® H30TM (8 nm, HMDS), HDK® H30TX (8 nm, HMDS/PDMS), HDK® H3004 (12 nm, HMDS); Evonik R972 (16 nm, DDS), RY200S (16 nm, PDMS), R202 (16 nm, PDMS), R974 (12 nm, DDS), RY200 (12 nm, PDMS), RX200 (12 nm, HMDS), R8200 (12 nm, HMDS), R805 (12 nm, alkyl silane), R104 (12 nm, alkyl silane), RX300 (8 nm, HMDS), R812 (8 nm, HMDS), R812S (8 nm, HMDS), and R106 (8 nm, alkyl silane); and Cabot TS530 (8 nm, HMDS).

In embodiments, the toner surface additive formulation contains a non-titanium dioxide positive charging metal oxide surface additive. The non-titanium dioxide positive charging metal oxide surface additive can be any suitable metal oxide additive that provides positive charging. Positive charging metal oxide additives may be identified as such by the additive manufacturer or additive vendor. In embodiments, additives that are either Bronsted or Lewis basic are suitable positive charging metal oxide additives. Suitable positive charging metal oxide additives also include amphoteric compounds. Amphoteric means the material has both acidic and basic groups, such that the compound acts as either Bronsted or Lewis acids and bases. In embodiments, the positive charging metal oxide surface additive comprises at least one member of the group consisting of a Bronsted base, a Lewis base, and an amphoteric compound. Not suitable for positive charging are purely acidic compounds, such as silica. In some embodiments, silica could be treated with a basic or an amphoteric surface treatment such that it was suitable as the positive charging metal oxide additive. Examples of such basic treatments are for example $NR_2$/$NR_3^+$ groups, where R in embodiments is an alkyl group, such as those in Wacker positive charging silicas. One such known positive charging treatment suitable for silica, that has a basic functional group is aminopropyl triethoxysilane. Metal oxides that are either basic or amphoteric include those metal oxides that have oxidation states of 3 for amphoteric oxides, or 2 for basic oxides. It should be noted some metal oxides with 2 may be considered amphoteric. Thus, $TiO_2$ and $ZnO_2$ are both basic oxides, though they still have some amphoteric character. Other examples of basic metal oxides with oxidation state 2 include CaO, MgO, FeO, CrO and MnO. Examples of amphoteric inorganic materials that are suitable as positive additives, are BeO, $Al_2O_3$, $GA_2O_3$, $In_2O_3$, $Tl_2O_3$, $GeO_2$, SnO, $SnO_2$, PbO, $PBO_2$, $As_2O_3$, $Sb_2O_3$, $Bi_2O_3$, and $Fe_2O_3$. Titanates are oxides comprised of two different metals, titanium in the +2 or +4 oxidation state and another metal in a +2 oxidation state. Ti in a +4 oxidation state is acidic, but the metal in the +2 oxidation state is basic. Thus titanates based on Ti +4 are amphoteric and are in embodiments suitable as the positive charging metal oxide additive. Examples of suitable titanates include $CaTiO_3$, $BaTiO_3$, $MgTiO_3$, $MnTiO_3$ and $SrTiO_3$. Aluminum titanate, $Al_2TiO_5$ with Al in the +3 oxidation state and Ti in the +2 oxidation state, is amphoteric and also suitable as the positive charging metal oxide additive. In embodiments, the non-titanium dioxide positive charging surface additive is selected from the group consisting of aluminum oxide and strontium titanate, and combinations thereof. In embodiments, the non-titanium dioxide positive charging surface additive is aluminum oxide. In embodiments, the non-titanium dioxide positive charging metal oxide additive is an additive that comprises a nitrogen containing molecular structure.

The non-titanium dioxide positive charging metal oxide surface additive can be surface treated. In embodiments, the non-titanium dioxide positive charging metal oxide surface additive is selected from the group consisting of alkyl silane treated aluminum oxide, polydimethylsiloxane treated aluminum oxide, and combinations thereof. In specific embodiments, the alkyl silane treatment of the non-titanium dioxide positive charging metal oxide surface additive may comprise an amino group, such as for example an amine, an imide or an amide. In embodiments, specific positive charging surface additives include Wacker treated silicas HDK® H13TA (16 nm, PDMS-$NR_2$/$NR_3^+$), HDK® H30TA (8 nm, PDMS-$NR_2$/$NR_3^+$); HDK® H2015EP (12 nm, PDMS-$NR_2$/$NR_3^+$); HDK® H2050EP (10 nm, PDMS-$NR_2$/$NR_3^+$); HDK® H2150VP (10 nm, PDMS-$NR_2$/$NR_3$); HDK® H3050VP (8 nm, PDMS-$NR_2$/$NR_3^+$); Cabot TG-820F (8 nm); Evonik C805 (13 nm, octylsilane), Aluminum Oxide C (13 nm, untreated), Aeroxide Alu C 100 (10 nm, untreated), Aeroxide Alu C 130 (13 nm, untreated); Cabot SpectrAL 81 (21 nm, untreated), and Cabot SpectrAl 100 (18 nm, untreated).

In embodiments, a total surface area coverage of all of the surface additives combined is 100 to 140 percent of the parent toner particle surface area. The parent toner particle is the toner particle without external additives.

Toner Preparation.

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by emulsion-aggregation processes, such as a process that includes aggregating a mixture of an optional wax and any other desired or required additives, and emulsions including the resins described above, optionally in surfactants as described above, and then coalescing the aggregate mixture. A mixture may be prepared by adding an optional wax or other materials, which may also be optionally in a dispersion(s) including a surfactant, to the emulsion, which may be a mixture of two or more emulsions containing the resin. The pH of the resulting mixture may be adjusted by an acid such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 600 to about 4,000 revolutions per minute. Homogenization may be accomplished by any suitable means, including, for example, an IKA ULTRA TURRAX® T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 8% by weight, in embodiments from about 0.2% to about 5% by weight, in other embodiments from about 0.5% to about 5% by weight, of the resin in the mixture. This provides a sufficient amount of agent for aggregation.

In order to control aggregation and coalescence of the particles, in embodiments the aggregating agent may be metered into the mixture over time. For example, the agent may be metered into the mixture over a period of from about 5 to about 240 minutes, in embodiments from about 30 to about 200 minutes. The addition of the agent may also be done while the mixture is maintained under stirred conditions, in embodiments from about 50 rpm to about 1,000 rpm, in other embodiments from about 100 rpm to about 500 rpm, and at a temperature that is below the glass transition temperature of the resin as discussed above, in embodiments from about 30° C. to about 90° C., in embodiments from about 35° C. to about 70° C.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size.

The aggregation thus may proceed by maintaining the elevated temperature, or slowly raising the temperature to, for example, from about 40° C. to about 100° C., and holding the mixture at this temperature for a time from about 0.5 hours to about 6 hours, in embodiments from about hour 1 to about 5 hours, while maintaining stirring, to provide the aggregated particles. Once the predetermined desired particle size is reached, then the growth process is halted. In embodiments, the predetermined desired particle size is within the toner particle size ranges mentioned above.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

In embodiments, after aggregation, but prior to coalescence, a shell may be applied to the aggregated particles.

Resins which may be utilized to form the shell include, but are not limited to, the amorphous resins described above for use in the core. Such an amorphous resin may be a low molecular weight resin, a high molecular weight resin, or combinations thereof. In embodiments, an amorphous resin which may be used to form a shell in accordance with the present disclosure may include an amorphous polyester of formula I above.

In some embodiments, the amorphous resin utilized to form the shell may be crosslinked. For example, crosslinking may be achieved by combining an amorphous resin with a crosslinker, sometimes referred to herein, in embodiments, as an initiator. Examples of suitable crosslinkers include, but are not limited to, for example free radical or thermal initiators such as organic peroxides and azo compounds described above as suitable for forming a gel in the core. Examples of suitable organic peroxides include diacyl peroxides such as, for example, decanoyl peroxide, lauroyl peroxide and benzoyl peroxide, ketone peroxides such as, for example, cyclohexanone peroxide and methyl ethyl ketone, alkyl peroxyesters such as, for example, t-butyl peroxy neodecanoate, 2,5-dimethyl 2,5-di(2-ethyl hexanoyl peroxy) hexane, t-amyl peroxy 2-ethyl hexanoate, t-butyl peroxy 2-ethyl hexanoate, t-butyl peroxy acetate, t-amyl peroxy acetate, t-butyl peroxy benzoate, t-amyl peroxy benzoate, oo-t-butyl o-isopropyl mono peroxy carbonate, 2,5-dimethyl 2,5-di(benzoyl peroxy) hexane, oo-t-butyl o-(2-ethyl hexyl) mono peroxy carbonate, and oo-t-amyl o-(2-ethyl hexyl) mono peroxy carbonate, alkyl peroxides such as, for example, dicumyl peroxide, 2,5-dimethyl 2,5-di(t-butyl peroxy) hexane, t-butyl cumyl peroxide, u-a-bis (t-butyl peroxy) diisopropyl benzene, di-t-butyl peroxide and 2,5-dimethyl 2,5di(t-butyl peroxy) hexyne-3, alkyl hydroperoxides such as, for example, 2,5-dihydro peroxy 2,5-dimethyl hexane, cumene hydroperoxide, t-butyl hydroperoxide and t-amyl hydroperoxide, and alkyl peroxyketals such as, for example, n-butyl 4,4-di(t-butyl peroxy) valerate, 1,1-di(t-butyl peroxy) 3,3,5-trimethyl cyclohexane, 1,1-di(t-butyl peroxy) cyclohexane, 1,1-di(t-amyl peroxy) cyclohexane, 2,2-di(t-butyl peroxy) butane, ethyl 3,3-di(t-butyl peroxy) butyrate and ethyl 3,3-di(t-amyl peroxy) butyrate, and combinations thereof. Examples of suitable azo compounds include 2,2,'-azobis(2,4-dimethylpentane nitrile), azobis-isobutyronitrile, 2,2,-azobis (isobutyronitrile), 2,2,-azobis(2,4-dimethyl valeronitrile), 2,2'-azobis (methyl butyronitrile), 1,1'-azobis(cyano cyclohexane), other similar known compounds, and combinations thereof.

The crosslinker and amorphous resin may be combined for a sufficient time and at a sufficient temperature to form the crosslinked polyester gel. In embodiments, the crosslinker and amorphous resin may be heated to a temperature of from about 25° C. to about 99° C., in embodiments from about 30° C. to about 95° C., for a period of time from about 1 minute to about 10 hours, in embodiments from about 5 minutes to about 5 hours, to form a crosslinked polyester resin or polyester gel suitable for use as a shell.

Where utilized, the crosslinker may be present in an amount of from about 0.001% by weight to about 5% by weight of the resin, in embodiments from about 0.01% by weight to about 1% by weight of the resin. The amount of CCA may be reduced in the presence of crosslinker or initiator.

A single polyester resin may be utilized as the shell or, as noted above, in embodiments a first polyester resin may be combined with other resins to form a shell. Multiple resins may be utilized in any suitable amounts. In embodiments, a first amorphous polyester resin, for example a low molecular weight amorphous resin of formula I above, may be present in an amount of from about 20 percent by weight to about 100 percent by weight of the total shell resin, in embodiments from about 30 percent by weight to about 90 percent by weight of the total shell resin. Thus, in embodiments a second resin, in embodiments a high molecular weight amorphous resin, may be present in the shell resin in an amount of from about 0 percent by weight to about 80 percent by weight of the total shell resin, in embodiments from about 10 percent by weight to about 70 percent by weight of the shell resin.

Following aggregation to the desired particle size and application of any optional shell, the particles may then be coalesced to the desired final shape, the coalescence being achieved by, for example, heating the mixture to a temperature from about 45° C. to about 100° C., in embodiments from about 55° C. to about 99° C., which may be at or above the glass transition temperature of the resins utilized to form the toner particles, and/or reducing the stirring, for example to from about 100 rpm to about 400 rpm, in embodiments from about 200 rpm to about 300 rpm. The fused particles can be measured for shape factor or circularity, such as with a SYSMEX FPIA 2100 analyzer, until the desired shape is achieved.

Coalescence may be accomplished over a period of time from about 0.01 to about 9 hours, in embodiments from about 0.1 to about 4 hours.

In embodiments, after aggregation and/or coalescence, the pH of the mixture may then be lowered to from about 3.5 to about 6 and, in embodiments, to from about 3.7 to about 5.5 with, for example, an acid, to further coalesce the toner aggregates. Suitable acids include, for example, nitric acid, sulfuric acid, hydrochloric acid, citric acid and/or acetic acid. The amount of acid added may be from about 0.1 to about 30 percent by weight of the mixture, and in embodiments from about 1 to about 20 percent by weight of the mixture.

The mixture may be cooled, washed and dried. Cooling may be at a temperature of from about 20° C. to about 40° C., in embodiments from about 22° C. to about 30° C., over a period of time of from about 1 hour to about 8 hours, in embodiments from about 1.5 hours to about 5 hours.

In embodiments, cooling a coalesced toner slurry may include quenching by adding a cooling media such as, for example, ice, dry ice and the like, to effect rapid cooling to a temperature of from about 20° C. to about 40° C., in embodiments of from about 22° C. to about 30° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture may not be feasible or practical, neither by the introduction of a cooling medium into the toner mixture, or by the use of jacketed reactor cooling.

Subsequently, the toner slurry may be washed. The washing may be carried out at a pH of from about 7 to about 12, in embodiments at a pH of from about 9 to about 11. The washing may be at a temperature of from about 30° C. to about 70° C., in embodiments from about 40° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying may be carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

The surface additive formulation described herein can be blended with the toner particles after formation. The surface additive formulation may be applied to the toner parent particles utilizing any means within the purview of those skilled in the art including, but not limited to, mechanical impaction and/or electrostatic attraction.

In embodiments, a toner process herein comprises: contacting at least one resin; an optional wax; an optional colorant; and an optional aggregating agent; heating to form aggregated toner particles; optionally, adding a shell resin to the aggregated toner particles, and heating to a further elevated temperature to coalesce the particles; adding a surface additive comprising: at least one medium silica surface additive having an average primary particle diameter of 30 to 50 nanometers, the at least one medium silica provided at a surface area coverage of 40 to 100 percent of the parent toner particle surface area; at least one large cross-linked organic polymeric additive having an average primary particle diameter of 75 to 120 nanometers, the at least one large cross-linked organic polymeric additive provided at a surface area coverage of 5 to 29 percent of the parent toner particle surface area; at least one positive charging surface additive, wherein the at least one positive charging surface additive is: (a) a titanium dioxide surface additive having an average primary particle size of 15 to 40 nanometers, the titanium dioxide present in an amount of less than or equal to 1 part per hundred based on 100 parts of the parent toner particles; and wherein the parent toner particles further contain a small silica having an average primary particle diameter of 8 to 16 nanometers, the small silica present at a surface area coverage of 5 to 75 percent of the parent toner particle surface area; or (b) a non-titanium dioxide positive charging metal oxide surface additive, wherein the non-titanium dioxide positive charging metal oxide surface additive has an average primary particle size of 8 to 30 nanometers, and wherein the non-titanium dioxide positive charging metal oxide surface additive is present at a surface area coverage of 5 to 15 percent of the parent toner particle surface area; and wherein the parent toner particles further optionally contain a small silica having an average primary particle diameter of 8 to 16 nanometers, the small silica present at a surface area coverage of 0 to 75 percent of the parent toner particle surface area; and wherein a total surface area coverage of all of the surface additives combined is 100 to 140 percent of the parent toner particle surface area; and optionally, recovering the toner particles.

In embodiments, toners of the present disclosure may be utilized as ultra low melt (ULM) toners. In embodiments, the dry toner particles having a core and/or shell may, exclusive of external surface additives, have one or more the following characteristics:

(1) Volume average diameter (also referred to as "volume average particle diameter") of from about 3 to about 25 micrometers (μm), in embodiments from about 4 to about 15 μm, in other embodiments from about 5 to about 12 μm.

(2) Number Average Geometric Size Distribution (GSDn) and/or Volume Average Geometric Size Distribution (GSDv): In embodiments, the toner particles described in (1) above may have a narrow particle size distribution with a lower number ratio GSD of from about 1.15 to about 1.38, in other embodiments, less than about 1.31. The toner particles of the present disclosure may also have a size such that the upper GSD by volume in the range of from about 1.20 to about 3.20, in other embodiments, from about 1.26 to about 3.11. Volume average particle diameter D50V, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

(3) Shape factor of from about 105 to about 170, in embodiments, from about 110 to about 160, SFl*a. Scanning electron microscopy (SEM) may be used to determine the shape factor analysis of the toners by SEM and image analysis (IA). The average particle shapes are quantified by employing the following shape factor (SFl*a) formula:

$$SFl*a=10077\pi d^2/(4A),$$

where A is the area of the particle and d is its major axis. A perfectly circular or spherical particle has a shape factor of exactly 100. The shape factor SFl*a increases as the shape becomes more irregular or elongated in shape with a higher surface area.

(4) Circularity of from about 0.92 to about 0.99, in other embodiments, from about 0.94 to about 0.975. The instrument used to measure particle circularity may be an FPIA-2100 manufactured by SYSMEX, following the manufacturer's instructions.

The characteristics of the toner particles may be determined by any suitable technique and apparatus and are not limited to the instruments and techniques indicated hereinabove.

The toner particles thus formed may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™ and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

The toners can be utilized for electrostatographic or electrophotographic processes. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

In embodiments where the toner resin is crosslinkable, such crosslinking may be accomplished in any suitable manner. For example, the toner resin may be crosslinked during fusing of the toner to the substrate where the toner resin is crosslinkable at the fusing temperature. Crosslinking also may be effected by heating the fused image to a temperature at which the toner resin will be crosslinked, for example in a post-fusing operation. In embodiments, crosslinking may be effected at temperatures of from about 160° C. or less, in embodiments from about 70° C. to about 160° C., in other embodiments from about 80° C. to about 140° C.

EXAMPLES

The following Examples are being submitted to further define various species of the present disclosure. These Examples are intended to be illustrative only and are not intended to limit the scope of the present disclosure. Also, parts and percentages are by weight unless otherwise indicated.

Cross-Linked Organic Polymeric Surface Additive.

A cross-linked organic polymeric additive latex was prepared at a 300-gallon scale. The latex was prepared via emulsion polymerization using a mixture of monomers including 74.2 weight % cyclohexyl methacrylate (CHMA), 25 weight % divinyl benzene (DVB), and 0.8 weight % dimethylaminoethyl methacrylate (DMAEMA). To prepare the latex, an aqueous phase of 433.5 kg of distilled water and 0.96 kg of sodium lauryl sulfate was added to a 300-gallon reactor. An emulsified monomer was prepared separately, with 221 kg of distilled water, 5.91 kg of sodium lauryl sulfate, 126.5 kg of cyclohexyl methacrylate, 42.5 kg of Divinyl benzene, and 1.36 g of dimethylaminoethyl methacrylate (DMAEMA). To the aqueous phase in the 300-gal reactor was added 5 weight % (19.8 kg) of the emulsified monomer to act as a seed for the polymerization. The 300-galon reactor was then heated to the polymerization temperature of 77° C. Separately, an initiator solution of 0.645 kg ammonium persulfate was prepared in 18.2 kg of distilled water. The initiator solution was then added to the reactor. After the initiator addition was complete, the rest of the emulsified monomer was added over a period of 2 hours. After the addition of emulsified monomer was complete, the latex was heated according to the following protocol: 1 hour at 77° C., 2 hours ramp up to 87° C., and 2 hours at 87° C. During the heating, 0.4% NaOH solution was added as required to maintain a pH of between about 5 and 6. The latex was then cooled to room temperature. The final latex was 95 nanometers (nm) size. The latex was spray dried using a dual liquid nozzle DL41 spray dryer from Yamato Scientific Co. with drying conditions using an atomizing pressure of 4 kgf/cm$^2$, a sample feed rate setting of 3, a temperature of 140° C., an aspirator flow rate of 4 m$^3$/minute. The dried cross-linked organic polymeric additive is denoted as COPA in the examples.

Measurement Protocols.

Toner additive blending for all toners was done by adding 50 grams of the toner and the toner surface additives as described in Table 1, to an SKM blender, then blended for about 30 seconds at approximately 12500 rpm. A black Xerox® 700 Digital Color Press emulsion-aggregation parent toner was utilized for these blends.

Toner charging of all toners blended with surface additive package was done with the following procedure. To 30 grams of Xerox® 700 carrier in a 60 mL glass bottle was added 5 pph of toner (1.5 grams) into the carrier. Samples were conditioned three days in a low-humidity zone (J zone) at 21.1° C. and 10% relative humidity (RH), and in a separate sample in a high humidity zone (A zone) at about 28° C./85% RH. The developers were charged using a Turbula mixer for 60 minutes.

The charge for all toners was measured as the charge per mass ratio (Q/M), by the total blow-off charge method, measuring the charge on a Faraday cage containing the developer after removing the toner by blow-off in a stream of air. The total charge collected in the cage is divided by the mass of toner removed by the blow-off, by weighing the cage before and after blow-off to give the Q/M ratio. The toner charge was also measured in the form of Q/D, the charge to diameter ratio. The Q/D was measured using a charge spectrograph with a 100 V/cm field, and was measured visually as the midpoint of the toner charge distribution. The charge was reported in millimeters of displacement from the zero line (mm displacement can be converted to femtocoulombs/micron (fC/μm) by multiplying by 0.092).

Toner Blocking Measurement.

Blocking for all toners was determined by measuring the toner cohesion at elevated temperature above room temperature for the toner blended with surface additives. Toner blocking measurement was completed as follows: two grams of additive blended toner was weighed into an open dish and conditioned in an environmental chamber at the specified elevated temperature and 50% relative humidity. After 17 hours the samples were removed and acclimated in ambient conditions for about 30 minutes. Each re-acclimated sample was measured by sieving through a stack of two pre-weighed mesh sieves, which were stacked as follows: 1000 μm on top and 106 μm on bottom.

The sieves were vibrated for about 90 seconds at about 1 mm amplitude with a Hosokawa flow tester. After the vibration was completed the sieves were reweighed and toner blocking is calculated from the total amount of toner remaining on both sieves as a percentage of the starting weight. Thus, for a 2 gram toner sample, if A is the weight of toner left the top 1000 μm screen and B is the weight of toner left the bottom 106 μm screen, the toner blocking percentage is calculated by: % blocking=50 (A+B).

Toner Flow Cohesion Measurement.

For all toners, two grams of the blended toner at lab ambient conditions is placed on a the top screen in a stack of three pre-weighed mesh sieves, which were stacked as follows in a Hosokawa flow tester: 53 μm on top, 45 μm in the middle, and 38 μm on the bottom. A vibration of 1 mm amplitude is applied to the stack for 90 seconds. The flow cohesion % is calculated as: % Cohesion=(50*A+30*B+10*C).

Table 1 shows the surface additive compositions and Table 2 shows the charging, blocking and flow cohesion measurements for all the examples and comparative examples. The SAC (surface area coverage) is calculated for each additive in the table, as well as the total SAC for all of the additives excluding the optional additives, which are added for BCR and photoreceptor cleaning: 0.18% Zn stearate and 0.2% strontium titanate. These cleaning additives can be ignored in the following discussion of the examples, as they can be independently varied for cleaning, without a significant impact on charge, blocking and flow properties.

All of the additive packages in Table 1 have less than 1% titanium dioxide, as is preferred. All packages have a first medium silica and a second medium silica, as well as either a large silica or an organic polymeric additive. Comparative Example 1 has titania, medium silica and large silica, but no small silica, which results in a high weight % loading of additives of 5.8 weight %. Since additive cost is by weight, this additive package is expensive. Also, the large silica is the most expensive additive. For good blocking and aging performance in the printer it is however desirable that the SAC be kept relatively high, ideally at least 100%. So it is difficult to reduce the cost of the additives while maintaining the required SAC.

Comparative Example 2 adds small silica to the design of Comparative Example 1, but reduces the medium silicas and increases the titanium dioxide. These changes maintain a similar SAC as desired for good aging performance, but does lower the total weight % additives, thus improving the cost. The developer performance as shown in the table is similar to Comparative Example 1.

Example 1 with titania is the same additive formulation as Comparative Example 2, except that the large silica is replaced by the organic polymeric additive. The result is similar SAC as Comparative Example 2. The overall total additive loading is lower than Comparative Example 2, so this example has a lower cost additive formulation. Also, the organic polymeric additive is also less expensive by weight % than the large silica, thus the cost of this additive formulation is further reduced. The developer performance of this additive formulation is similar to the comparative examples, with a slightly lower blocking temperature by about 1° C., and an improved RH sensitivity of the charge, with desirably higher A-zone/J-zone charge ratio.

Example 2 has replaced all the titania with C805 aluminum oxide as a positive charging metal oxide additive, and has replaced the large silica with the cross-linked organic polymeric additive. This toner has no small silica. To increase the SAC, the medium silica content has been increased, and, as a result, the final total SAC is higher than the other examples. Such a higher SAC may have some benefit to stabilize aging performance in the printer. Due to this higher SAC, the total weight % of additives, not including the optional additives is higher than the other examples. Compared to Comparative Example 1, the higher SAC would tend to make this additive package more expensive, but this is compensated by the lower cost of the organic polymeric additive relative to the very expensive large silica. This design has similar performance to the Comparative Examples, with slightly better blocking by 1° C., the best RH sensitivity, and has the benefit of being completely free of titanium dioxide.

Example 3 has the same additive formulation as Example 1, except titania is replaced by the positive charging aluminum oxide additive C805. The weight % additive loading is lower than in the Comparative Example 2, and also is lower than Example 1, but with a similar SAC. Also, Example 3 uses the less expensive organic polymeric additive to replace the large silica in the Comparative Examples. Thus, Example 3 is the least expensive additive formulation while maintaining a desirably high SAC. Performance is very similar to the comparative examples, excepting that blocking is slightly worse.

Comparative Example 4 has the same additive formulation as Example 3, except that the large silica is used instead of the organic polymeric additive. To maintain the same SAC more of the large silica was used, resulting in a higher additive loading than Example 3. Also, the large silica is the most expensive additive, more expensive than the organic polymeric additive, so Comparative Example 4 is more expensive than Example 3. Performance is similar to the other Comparative Examples, except blocking is worse. Blocking is similar to Example 3.

TABLE 1

| Additives | | Comparative Example 1 | Comparative Example 2 | Example 1 | Example 2 | Example 3 | Comparative Example 3 |
|---|---|---|---|---|---|---|---|
| 1st Medium Silica | Type | RY50L | RY50L | RY50L | RY50L | RY50L | RY50L |
| | wt % | 2.4 | 1.2 | 1.2 | 2.32 | 1.2 | 1.2 |
| | Size (nm) | 40 | 40 | 40 | 40 | 40 | 40 |
| | Density ($g/cm^3$) | 2.2 | 2.2 | 2.2 | 2.2 | 2.2 | 2.2 |
| | SAC % | 52.6 | 26.3 | 26.3 | 50.8 | 26.3 | 26.3 |
| 2nd Medium Silica | Type | RX50 | RX50 | RX50 | RX50 | RX50 | RX50 |
| | wt % | 1.6 | 0.8 | 0.8 | 2.8 | 0.8 | 0.8 |
| | Size (nm) | 40 | 40 | 40 | 40 | 40 | 40 |
| | Density ($g/cm^3$) | 2.2 | 2.2 | 2.2 | 2.2 | 2.2 | 2.2 |
| | SAC % | 35.1 | 17.5 | 17.5 | 61.4 | 17.5 | 17.5 |
| Polymeric Organic Additive or Large Silica | Type | X24-9163A | X24-9163A | COPA | COPA | COPA | X24-9163A |
| | wt % | 1.63 | 1.63 | 0.95 | 0.9 | 0.95 | 1.63 |
| | Size (nm) | 115 | 115 | 95 | 95 | 95 | 115 |
| | Density ($g/cm^3$) | 1.8 | 1.8 | 1.14 | 1.14 | 1.14 | 1.8 |
| | SAC % | 15.2 | 15.2 | 16.9 | 16.0 | 16.9 | 15.2 |
| Titanium Dioxide or Aluminum Dioxide | Type | STT100H | STT100H | STT100H | C805 | C805 | C805 |
| | wt % | 0.15 | 0.3 | 0.3 | 0.15 | 0.15 | 0.15 |
| | Size (nm) | 40 | 40 | 40 | 13 | 13 | 13 |
| | Density ($g/cm^3$) | 3.6 | 3.6 | 3.6 | 4 | 4 | 4 |
| | SAC % | 2.0 | 4.0 | 4.0 | 5.6 | 5.6 | 5.6 |
| Small Silica | Type | RY200L | RY200L | RY200L | RY200L | RY200L | RY200L |
| | wt % | 0 | 0.5 | 0.5 | 0 | 0.5 | 0.5 |
| | Size (nm) | 12 | 12 | 12 | 12 | 12 | 12 |
| | Density ($g/cm^3$) | 2.2 | 2.2 | 2.2 | 2.2 | 2.2 | 2.2 |
| | SAC % | 0 | 36.5 | 36.5 | 0.0 | 36.5 | 36.5 |
| Calculated SAC | % | 105 | 100 | 101 | 134 | 103 | 101 |
| Total loading | wt % | 5.8 | 4.4 | 3.8 | 6.2 | 3.6 | 4.3 |

TABLE 2

| | | Comparative Example 1 | Comparative Example 2 | Example 1 | Example 2 | Example 3 | Comparative Example 3 |
|---|---|---|---|---|---|---|---|
| A-zone Charge | Q/D (mm) | 6.5 | 5.1 | 6.2 | 6.8 | 4.9 | 5 |
| | Q/M (μC/g) | 33 | 28 | 33 | 35 | 28 | 27 |
| J-zone Charge | Q/D (mm) | 12.2 | 12.3 | 13.6 | 11.1 | 11.15 | 9.65 |
| | Q/M (μC/g) | 59 | 59 | 73 | 57 | 62 | 48 |
| Blocking | ° C. | 55.2 | 55.1 | 54.3 | 56.3 | 54.2 | 54.2 |
| Tribo Ratio Q/D | A-zone J-zone | 0.53 | 0.41 | 0.45 | 0.61 | 0.44 | 0.52 |
| Tribo Ratio Q/M | A-zone J-zone | 0.56 | 0.47 | 0.45 | 0.61 | 0.45 | 0.56 |

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. A toner comprising:

a parent toner particle comprising at least one resin, in combination with an optional colorant, and an optional wax; and a surface additive formulation comprising:

at least one medium silica surface additive having an average primary particle diameter of 30 to 50 nanometers, the at least one medium silica provided at a surface area coverage of 40 to 100 percent of the parent toner particle surface area;

at least one large cross-linked organic polymeric additive having an average primary particle diameter of 75 to 120 nanometers, the at least one large cross-linked organic polymeric additive provided at a surface area coverage of 5 to 29 percent of the parent toner particle surface area;

at least one positive charging surface additive, wherein the at least one positive charging surface additive is:

(a) a titanium dioxide surface additive having an average primary particle size of 15 to 40 nanometers, the titanium dioxide present in an amount of less than or equal to 1 part per hundred based on 100 parts of the parent toner particles; and wherein the parent toner particles further contain a small silica having an average primary particle diameter of 8 to 16 nanometers, the small silica present at a surface area coverage of 5 to 75 percent of the parent toner particle surface area; or (b) a non-titanium dioxide positive charging surface metal oxide surface additive, wherein the non-titanium dioxide positive charging metal oxide additive has an average primary particle size of 8 to 30 nanometers, and wherein the non-titanium dioxide positive charging metal oxide surface additive is present at a surface area coverage of 5 to 15 percent of the parent toner particle surface area; and wherein the parent toner particles further optionally contain a small silica having an average primary particle diameter of 8 to 16 nanometers, the small silica present at a surface area coverage of 0 to 75 percent of the parent toner particle surface area; and wherein a total surface area coverage of all of the surface additives combined is 100 to 140 percent of the parent toner particle surface area.

2. The toner of claim 1, wherein the at least one medium silica comprises two or more medium silicas, and wherein the two or more medium silicas comprise surface-treated medium silicas selected from the group consisting of an alkyl silane treated silica, a polydimethylsiloxane treated silica, and combinations thereof.

3. The toner of claim 1, wherein the at least one medium silica comprises a first medium silica that is an alkyl silane treated silica and a second medium silica that is a polydimethylsiloxane treated silica.

4. The toner of claim 1, where the at least one large cross-linked organic polymeric additive is a copolymer comprising:

a first monomer having a high carbon to oxygen ratio of from about 3 to about 8;

a second monomer comprising two or more vinyl groups, wherein the second monomer is present in the copolymer in an amount of from greater than about 8 percent by weight to about 60 percent by weight, based on the weight of the copolymer; and optionally, a third monomer comprising an amine, wherein the third monomer is present in an amount of from about 0.5 percent by weight to about 5 percent by weight, based on the weight of the copolymer.

5. The toner of claim 4, wherein the first monomer of the copolymer comprises an aliphatic cycloacrylate selected from the group consisting of cyclohexyl methacrylate, cyclopropyl acrylate, cyclobutyl acrylate, cyclopentyl acrylate, cyclohexyl acrylate, cyclopropyl methacrylate, cyclobutyl methacrylate, cyclopentyl methacrylate, isobornyl methacrylate, benzyl methacrylate, phenyl methacrylate, and combinations thereof;

wherein the second monomer of the copolymer comprises a member of the group consisting of diethyleneglycol diacrylate, triethyleneglycol diacrylate, tetraethyleneglycol diacrylate, polyethyleneglycol diacrylate, 1,6-hexanediol diacrylate, neopentylglycol diacrylate, tripropyleneglycol diacrylate, polypropyleneglycol diacrylate, 2,2',-bis(4-(acryloxy/diethoxy)phenyl)propane, trimethylolpropane triacrylate, tetramethylolmethane tetraacrylate, ethyleneglycol dimethacrylate, diethyleneglycol dimethacrylate, triethyleneglycol dimethacrylate, tetraethyleneglycol dimethacrylate, polyethyleneglycol dimethacrylate, 1,3-butyleneglycol dimethacrylate, 1,6-hexanediol dimethacrylate, neopentylglycol dimethacrylate, polypropyleneglycol dimethacrylate, 2,2',-bis(4-(methacryloxy/diethoxy)phenyl)propane, 2,2',-bis(4-(methacryloxy/polyethoxy)phenyl)propane, trimethylolpropane trimethacrylate, tetramethylolmethane tetramethacrylate, divinyl benzene, divinyl naphthalene, divinyl ether, and combinations thereof; and wherein the third monomer comprises a member of the group consisting of dimethylaminoethyl methacrylate, diethylaminoethyl methacrylate, dipropylaminoethyl methacrylate, diisopropylaminoethyl methacrylate, dibutylaminoethyl methacrylate, and combinations thereof.

6. The toner of claim 1, wherein the non-titanium dioxide positive charging metal oxide surface additive is selected from the group consisting of aluminum oxide, strontium titanate, alkyl silane treated aluminum oxide, polydimethylsiloxane treated aluminum oxide, and combinations thereof.

7. The toner of claim 1, wherein the non-titanium dioxide positive charging metal oxide surface additive is selected from the group consisting of a metal oxide comprising at least one member of the group consisting of a Bronsted base, a Lewis base, and an amphoteric compound.

8. The toner of claim 1, wherein the non-titanium dioxide positive charging metal oxide surface additive is a silica that has been treated with a basic or an amphoteric surface treatment.

9. The toner of claim 1, wherein the small silica is selected from the group consisting of alkyl silane treated silica, polydimethysiloxane treated silica, and combinations thereof.

10. The toner of claim 1, wherein the small silica is present, and is present at a surface area coverage of 30 to 75 percent of the parent toner particle surface area.

11. The toner of claim 1, wherein the at least one resin of the parent toner particle comprises at least one amorphous polyester and at least one crystalline polyester.

12. The toner of claim 1, wherein the at least one resin of the parent toner particle comprises a first amorphous polyester and a second amorphous polyester that is different from the first amorphous polyester, and a crystalline polyester.

13. The toner of claim 1, wherein the at least one resin of the parent toner particle is selected from the group consisting of styrenes, acrylates, methacrylates, butadienes, isoprenes, acrylic acids, methacrylic acids, acrylonitriles, copolymers thereof, and combinations thereof.

14. The toner of claim 1, wherein the toner comprises a core-shell configuration;

wherein the core comprises at least one amorphous polyester and at least one crystalline polyester; and wherein the shell comprises at least one amorphous polyester.

15. The toner of claim 1, wherein the colorant is selected from cyan, magenta, yellow, black, or a combination thereof.

16. A toner process comprising:

contacting at least one resin; an optional wax; an optional colorant; and an optional aggregating agent;

heating to form aggregated toner particles;

optionally, adding a shell resin to the aggregated toner particles, and heating to a further elevated temperature to coalesce the particles;

adding a surface additive comprising:

at least one medium silica surface additive having an average primary particle diameter of 30 to 50 nanometers, the at least one medium silica provided at a surface area coverage of 40 to 100 percent of the parent toner particle surface area;

at least one large cross-linked organic polymeric additive having an average primary particle diameter of 75 to 120 nanometers, the at least one large cross-linked organic polymeric additive provided at a surface area coverage of 5 to 29 percent of the parent toner particle surface area;

at least one positive charging surface additive, wherein the at least one positive charging surface additive is:

(a) a titanium dioxide surface additive having an average primary particle size of 15 to 40 nanometers, the titanium dioxide present in an amount of less than or equal to 1 part per hundred based on 100 parts of the parent toner particles; and wherein the parent toner particles further contain a small silica having an average primary particle diameter of 8 to 16 nanometers, the small silica present at a surface area coverage of 5 to 75 percent of the parent toner particle surface area; or (b) a non-titanium dioxide positive charging metal oxide surface additive, wherein the non-titanium dioxide positive charging metal oxide surface additive has an average primary particle size of 8 to 30 nanometers, and wherein the non-titanium dioxide positive charging metal oxide surface additive is present at a surface area coverage of 5 to 15 percent of the parent toner particle surface area; and wherein the parent toner particles further optionally contain a small silica having an average primary particle diameter of 8 to 16 nanometers, the small silica present at a surface area coverage of 0 to 75 percent of the parent toner particle surface area; and wherein a total surface area coverage of all of the surface additives combined is 100 to 140 percent of the parent toner particle surface area; and optionally, recovering the toner particles.

17. The toner process of claim 16, wherein the at least one medium silica comprises two or more medium silicas, and wherein the two or more medium silicas comprise surface-treated medium silicas selected from the group consisting of an alkyl silane treated silica, a polydimethylsiloxane treated silica, and combinations thereof.

18. The toner process of claim 16, wherein the non-titanium dioxide positive charging metal oxide surface additive is selected from the group consisting of aluminum oxide, strontium titanate, alkyl silane treated aluminum oxide, polydimethylsiloxane treated aluminum oxide, and combinations thereof.

19. The toner process of claim 16, where the at least one large cross-linked organic polymeric additive is a copolymer comprising: a first monomer having a high carbon to oxygen ratio of from about 3 to about 8;

a second monomer comprising two or more vinyl groups, wherein the second monomer is present in the copolymer in an amount of from greater than about 8 percent by weight to about 60 percent by weight, based on the weight of the copolymer; and optionally, a third monomer comprising an amine, wherein the third monomer is present in an amount of from about 0.5 percent by weight to about 5 percent by weight, based on the weight of the copolymer.

20. The toner process of claim 19, wherein the first monomer of the copolymer comprises an aliphatic cycloacrylate selected from the group consisting of cyclohexyl methacrylate, cyclopropyl acrylate, cyclobutyl acrylate, cyclopentyl acrylate, cyclohexyl acrylate, cyclopropyl methacrylate, cyclobutyl methacrylate, cyclopentyl methacrylate, isobornyl methacrylate, benzyl methacrylate, phenyl methacrylate, and combinations thereof;

wherein the second monomer of the copolymer comprises a member of the group consisting of diethyleneglycol diacrylate, triethyleneglycol diacrylate, tetraethyleneglycol diacrylate, polyethyleneglycol diacrylate, 1,6-hexanediol diacrylate, neopentylglycol diacrylate, tripropyleneglycol diacrylate, polypropyleneglycol diacrylate, 2,2',-bis(4-(acryloxy/diethoxy)phenyl)propane, trimethylolpropane triacrylate, tetramethylolmethane tetraacrylate, ethyleneglycol dimethacrylate, diethyleneglycol dimethacrylate, triethyleneglycol dimethacrylate, tetraethyleneglycol dimethacrylate, polyethyleneglycol dimethacrylate, 1,3-butyleneglycol dimethacrylate, 1,6-hexanediol dimethacrylate, neopentylglycol dimethacrylate, polypropyleneglycol dimethacrylate, 2,2',-bis(4-(methacryloxy/diethoxy)phenyl)propane, 2,2',-bis(4-(methacryloxy/polyethoxy)phenyl)propane, trimethylolpropane trimethacrylate, tetramethylolmethane tetramethacrylate, divinyl benzene, divinyl naphthalene, divinyl ether, and combinations thereof; and wherein the third monomer comprises a member of the group consisting of dimethylaminoethyl methacrylate, diethylaminoethyl methacrylate, dipropylaminoethyl methacrylate, diisopropylaminoethyl methacrylate, dibutylaminoethyl methacrylate, and combinations thereof.

* * * * *